US009684278B2

(12) United States Patent
Numata et al.

(10) Patent No.: US 9,684,278 B2
(45) Date of Patent: Jun. 20, 2017

(54) IMAGE FORMING APPARATUS AND PROCESS FOR SUPPORTING CARTRIDGE USED FOR THE SAME

(71) Applicant: CANON KABUSHIKI KAISHA, Tokyo (JP)

(72) Inventors: Tetsuya Numata, Suntou-gun (JP); Naoya Asanuma, Susono (JP); Daisuke Hiramatsu, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/947,888

(22) Filed: Nov. 20, 2015

(65) Prior Publication Data

US 2016/0154373 A1 Jun. 2, 2016

(30) Foreign Application Priority Data

Nov. 28, 2014 (JP) ..... 2014-240826

(51) Int. Cl.
*G03G 21/18* (2006.01)
*G03G 21/16* (2006.01)

(52) U.S. Cl.
CPC ..... *G03G 21/1839* (2013.01); *G03G 21/1623* (2013.01); *G03G 21/1853* (2013.01); *G03G 2221/1684* (2013.01); *G03G 2221/1869* (2013.01)

(58) Field of Classification Search
CPC ..... G03G 21/1839; G03G 21/1853
USPC ..... 399/111
See application file for complete search history.

(56) References Cited

U.S. PATENT DOCUMENTS

| | | | | |
|---|---|---|---|---|
| 6,351,620 | B1 | 2/2002 | Miyabe | |
| 8,682,215 | B1 * | 3/2014 | Ueno | G03G 15/757 399/111 |
| 8,862,023 | B2 * | 10/2014 | Takayama | G03G 21/1853 399/110 |
| 2008/0152388 | A1 | 6/2008 | Ueno | |
| 2009/0317132 | A1 | 12/2009 | Asanuma | |
| 2011/0013932 | A1 | 1/2011 | Fujita | |
| 2015/0063834 | A1 * | 3/2015 | Kobayashi | G03G 15/043 399/12 |

FOREIGN PATENT DOCUMENTS

| | | | |
|---|---|---|---|
| EP | 2790065 | A1 | 10/2014 |
| JP | 2008-26486 | A | 2/2008 |
| JP | 2008-233867 | A | 10/2008 |

(Continued)

*Primary Examiner* — Billy Lactaoen
*Assistant Examiner* — Arlene Heredia Ocasio
(74) *Attorney, Agent, or Firm* — Canon U.S.A. Inc., IP Division

(57) ABSTRACT

An image forming apparatus includes a movement member arranged to move a cartridge and is movable between a first position for disposing the cartridge at a position where image formation is possible and a second position where the cartridge is attachable to and detachable from the movement member. At least one coupling provided in the cartridge is, when the movement member is at the first position, moved to a drive position where the coupling is arranged to engage with a drive member to rotate at least one rotating member, and while the movement member is being moved from the second to first positions, the at least one coupling is at an inclined position.

10 Claims, 28 Drawing Sheets

(56) References Cited

FOREIGN PATENT DOCUMENTS

| | | | |
|---|---|---|---|
| JP | 2010-79283 | A | 4/2010 |
| JP | 2010-122465 | A | 6/2010 |
| JP | 2010-140051 | A | 6/2010 |
| JP | 2011-100171 | A | 5/2011 |
| WO | 2009/151132 | A1 | 12/2009 |

* cited by examiner

IMAGE FORMING APPARATUS AND PROCESS FOR SUPPORTING CARTRIDGE USED FOR THE SAME

BACKGROUND OF THE INVENTION

Field of the Invention

The present invention relates to image forming apparatuses and cartridges used for the image forming apparatuses. The present invention can be particularly used for an electrophotographic copier, a printer, (such as a light-emitting diode (LED) printer or a laser beam printer), a facsimile machine, a word processor, and so forth.

Description of the Related Art

In an electrophotographic image forming apparatus, an electrophotographic photosensitive member serving as an image bearing member that typically has a drum shape, that is, a photosensitive drum is uniformly charged. Next, by selectively exposing the charged photosensitive drum to light, an electrostatic latent image (electrostatic image) is formed on the photosensitive drum. The electrostatic latent image formed on the photosensitive drum is subsequently developed into a toner image with toner as developer. The toner image formed on the photosensitive drum is transferred onto a recording medium such as recording paper or a plastic sheet. Then, by applying heat and pressure to the toner image transferred onto the recording medium, the toner image is fixed onto the recording medium. Thus, the image is recorded.

In general, maintenance including toner supply and maintenance of a variety of process devices is required for such an image forming apparatus. In order to facilitate the toner supply and the maintenance of the process devices, a process cartridge that is detachably attachable to a main body of the image forming apparatus has come into practical use. In this process cartridge, a photosensitive drum, a charging device, a developing device, a cleaning device, and so forth are gathered together in a frame so as to be provided as a cartridge.

Since maintenance of the apparatus can be performed by a user himself or herself with this process cartridge method, operability can be significantly improved, and the image forming apparatus with good usability can be provided. Thus, this process cartridge method is widely used for the image forming apparatus.

Furthermore, in order to receive a rotational drive force from the image forming apparatus main body in the above-described cartridge, the following structure described in Japanese Patent Laid-Open No. 2010-140051 is known. That is, a main-body-side engagement member provided with a rotational force applying portion at a distal end of a drive shaft that transmits a drive force of a motor is provided on an image forming apparatus main body (main body) side. In contrast, an inclinable coupling is provided at one end of a photosensitive drum in the longitudinal direction on a process cartridge side.

This coupling includes a rotational force receiving portion and a rotational force transmitting portion. The rotational force receiving portion is brought into engagement with the main-body-side engagement member so as to receive the drive force from the rotational force applying portion. The rotational force transmitting portion transmits the drive force received by the rotational force receiving portion to the photosensitive drum. The coupling is inclined so that the coupling can assume a first orientation and a second orientation. In the first orientation, rotational drive is transmitted from the main-body-side engagement member that is in engagement in a state substantially parallel to a rotational axis of the photosensitive drum. In the second orientation, engagement with the main-body-side engagement member is released.

Thus, the coupling assumes the second orientation when the process cartridge that is detachably attachable in a direction substantially perpendicular to the rotational axis direction of the main-body-side engagement member is attached or detached. In the second orientation, the coupling is inclined such that a distal end side of the coupling is moved further in a process cartridge attachment direction than a proximal end side of the coupling. Accordingly, the main-body-side engagement member and the coupling can be brought into engagement with each other so as to transmit the drive without a mechanism that moves the main-body-side engagement member in the rotational axis direction.

Nowadays, there is a demand for an increase in the capacity of a process cartridge. In order to realize this, however, the amount of toner is increased. This leads to an increase in the weight of the process cartridge. That is, a heavy process cartridge is attached to or detached from the image forming apparatus main body by the user. Here, in order to stably bring the above-described inclinable coupling into engagement with the main-body-side engagement member, the position of the coupling before the engagement needs to be stabilized. In particular, when the inclinable coupling is applied to the heavy process cartridge, a structure for attachment and detachment that allows the process cartridge to be more stably attached to and detached from the image forming apparatus is needed.

SUMMARY OF THE INVENTION

The present invention provides an image forming apparatus and a cartridge used for the image forming apparatus with which engagement of the inclinable coupling can be stably performed as further improvement of the above-described related art.

A first aspect of the present invention provides an image forming apparatus that includes an apparatus main body and a cartridge. The cartridge includes at least one rotating member and at least one coupling arranged to engage with a drive member on the apparatus main body side so as to receive a drive force to rotate the at least one rotating member. The image forming apparatus includes a movement member arranged to move the cartridge and which is movable between a first position for disposing the cartridge at a position where image formation is possible and a second position where the cartridge is attachable to and detachable from the movement member. When the movement member is positioned at the first position, the at least one coupling is arranged to engage with the drive member so as to be positioned at a drive position where the at least one coupling is able to rotate the at least one rotating member. While the movement member is being moved from the second position to the first position, the at least one coupling is at an inclined position where the at least one coupling is inclined such that a distal end portion of the at least one coupling is positioned further to a downstream side in a movement direction of the movement member from the second position to the first position than when the at least one coupling is positioned at the drive position.

A second aspect of the present invention provides a cartridge that is detachably attachable to an apparatus main body of an image forming apparatus and that includes an image bearing member, a developer bearing member, a first coupling, and a second coupling. A latent image can be formed on the image bearing member. The developer bearing member is arranged to bear developer so as to develop any latent image formed on the image bearing member. The first coupling is arranged to be brought into engagement with a first drive member on the apparatus main body side so as to receive a drive force to rotate the image bearing member. The second coupling is arranged to be brought into engagement with a second drive member on the apparatus main body side so as to receive a drive force to rotate the developer bearing member. The apparatus main body includes a movement member arranged to move the cartridge and that is movable between a first position for disposing the cartridge at a position where image formation is possible and a second position where the cartridge is attachable to and detachable from the movement member. When the movement member is positioned at the first position, the first coupling is brought into engagement with the first drive member so as to be positioned at a first drive position where the first coupling is able to rotate the image bearing member. While the movement member is being moved from the second position to the first position, the first coupling is at a first inclined position where the first coupling is inclined such that a distal end portion of the first coupling is positioned further to a downstream side in a movement direction of the movement member from the second position to the first position than when the first coupling is positioned at the first drive position. When the movement member is positioned at the first position, the second coupling is arranged to engage with the second drive member so as to be positioned at a second drive position where the second coupling is able to rotate the developer bearing member. While the movement member is being moved from the second position to the first position, the second coupling is at a second inclined position where the second coupling is inclined such that a distal end portion of the second coupling is positioned further to the downstream side in the movement direction of the movement member from the second position to the first position than when the second coupling is positioned at the second drive position.

A third aspect of the present invention provides a cartridge that is detachably attachable to an apparatus main body of an image forming apparatus and that includes an image bearing member, a developer bearing member, an image bearing member unit, a developing unit, a first coupling, a second coupling, a first projection, a second projection, and a third projection. A latent image can be formed on the image bearing member. The developer bearing member is arranged to bear developer so as to develop any latent image formed on the image bearing member. The image bearing member unit is arranged to support the image bearing member. The developing unit is arranged to support the developer bearing member and is connected to the image bearing member unit. The first coupling is provided in the image bearing member unit and arranged to receive a drive force to rotate the image bearing member. An inclination angle of the first coupling is variable. The second coupling is provided in the developing unit and arranged to receive a drive force to rotate the developer bearing member. An inclination angle of the second coupling is variable. The first projection projects from the image bearing member unit in an axial direction of the image bearing member. The second projection projects from the image bearing member unit in a direction identical to the direction in which the first projection projects. The third projection projects from the developing unit in a direction intersecting the axial direction. In a plane perpendicular to the axial direction, when a line that passes through the first projection and the second projection is a first line, a line that passes through the first projection and that is perpendicular to the first line is a second line, and a line that passes through the second projection and that is perpendicular to the first line is a third line, the second coupling and the third projection are disposed in a region interposed between the second line and the third line.

Further features of the present invention will become apparent from the following description of exemplary embodiments with reference to the attached drawings.

DESCRIPTION OF THE EMBODIMENTS

Embodiments of the present invention will be described in detail below with reference to the attached drawings. It is noted that, in the present application, a rotational axis direction of a photosensitive drum used in an electrophotographic system is defined as the longitudinal direction. It is also noted that a side in the longitudinal direction on which the photosensitive drum receives a drive force from a main body of an image forming apparatus (apparatus main body) is defined as a drive side and a side in the longitudinal direction opposite to the drive side is defined as a non-drive side. Here, the apparatus body refers to part of the image forming apparatus other than a process cartridge (cartridge B).

First Embodiment

The Image Forming Apparatus

Figure 2:
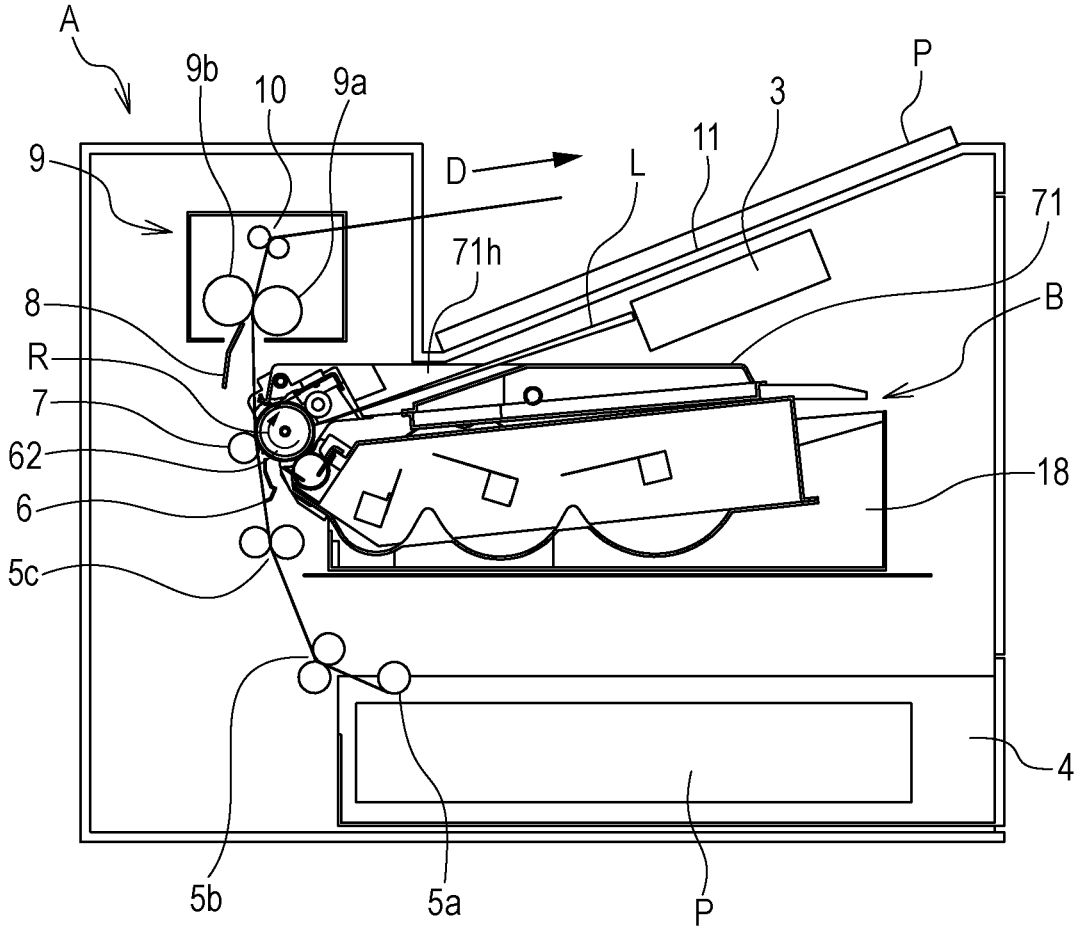
FIG. 2 is a sectional view of the image forming apparatus main body and the process cartridge of the image forming apparatus according to the embodiment of the present invention.

An image forming apparatus illustrated in FIG. 2 is an electrophotographic laser beam printer in which a process cartridge ("cartridge" hereafter) attached on a tray 18 serving as an attachment (movement member) is detachably attached to an apparatus main body A. When the cartridge B is attached to the apparatus main body, a light exposure device 3 (laser scanner unit) for forming a latent image on a photosensitive drum ("drum" hereafter) 62 of the cartridge B is disposed. Furthermore, a sheet tray 4 that contains a recording medium ("sheet material P" hereafter) on which an image is formed is disposed below the cartridge B.

Furthermore, components including the following components are sequentially arranged in a conveyance direction D of the sheet material P in the apparatus main body A. That is, a pickup roller 5*a*, a feed roller pair 5*b*, a conveyance roller pair 5*c*, a transfer guide 6, a transfer roller 7, a conveyance guide 8, a fixing device 9, a output roller pair 10, and an output tray 11. The fixing device 9 includes a heating roller 9*a* and a pressure roller 9*b*.

An Image Forming Process

Next, an outline of an image forming process is described. The drum 62 is rotated in an arrow R direction of FIG. 2 at a specified circumferential speed (process speed) in accordance with a print start signal. Furthermore, a charging roller 66, to which a bias voltage is applied, is in contact with an outer circumferential surface of the drum 62 so as to uniformly change the outer circumferential surface of the drum 62.

The light exposure device 3 emits a laser light L corresponding to image information. This laser light L passes through a laser opening 71*h* provided in a cleaning frame 71 of the cartridge B, so that the outer circumferential surface of the drum 62 is subjected to scanning exposure. Thus, an electrostatic latent image corresponding to the image information is formed on the outer circumferential surface of the drum 62.

Figure 3:
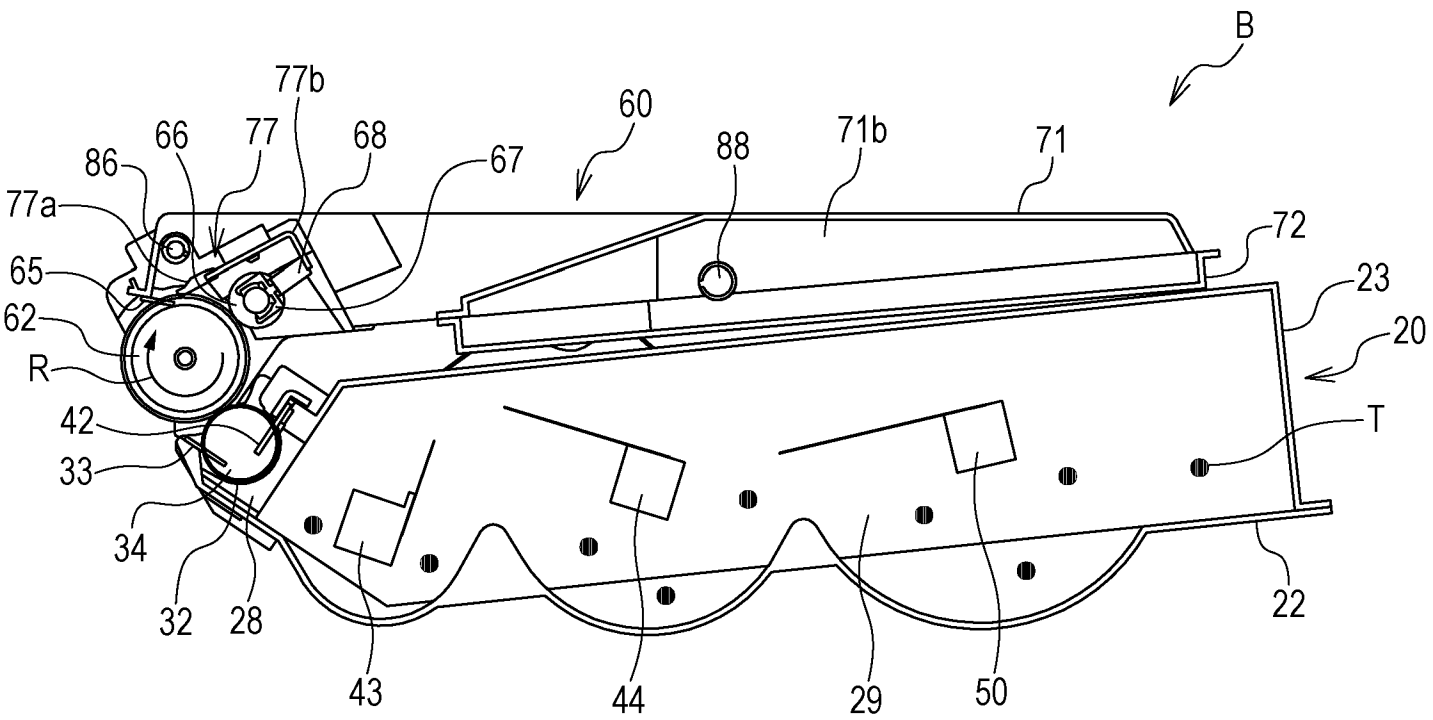
FIG. 3 is a sectional view of the process cartridge according to the embodiment.

Meanwhile, as illustrated in FIG. 3, in a developing unit 20 serving as a developing device, toner T in a toner chamber 29 is agitated and conveyed by rotation of a first conveyance member 43, a second conveyance member 44, and a third conveyance member 50 so as to be fed to a toner supply chamber 28. Toner T is borne on the surface of a developing roller 32 due to a magnetic force of a magnet roller 34 (stationary magnet). The toner T is triboelectrically charged by a developing blade 42, and a layer thickness of the toner T on an outer circumferential surface of the developing roller 32 is regulated by the developing blade 42. The electrostatic latent image on the outer circumferential surface of the drum 62 is developed with such toner T and visualized as a toner image (developer image).

The developing roller 32 serves as a developer bearing member that bears developer for developing the latent image (electrostatic latent image) formed on the drum 62. The drum 62 serves as an image bearing member that bears an image (toner image, latent image).

Furthermore, as illustrated in FIG. 2, the sheet material P contained in a lower portion of the apparatus main body A is fed from the sheet tray 4 by the pickup roller 5*a*, the feed roller pair 5*b*, and the conveyance roller pair 5*c* at timing adjusted to output timing of the laser light L. The sheet material P is conveyed to a transfer position between the drum 62 and the transfer roller 7 through the transfer guide 6. The toner image is sequentially transferred from the drum 62 onto the sheet material P at this transfer position.

The sheet material P onto which the toner image has been transferred is separated from the drum 62 and conveyed to the fixing device 9 along the conveyance guide 8. Then, the sheet material P passes through a nip between the heating roller 9*a* and the pressure roller 9*b* of the fixing device 9. A fixing process by heat and pressure is performed in this nip, thereby fixing the toner image onto the sheet material P. The sheet material P having undergone the fixing process for the toner image is conveyed to the output roller pair 10 and output to the output tray 11.

Referring to FIG. 3, after the transfer has been performed, residual toner on the outer circumferential surface of the drum 62 is removed by a cleaning blade 77. The removed toner is stored in a waste toner chamber 71*b* of a cleaning unit 60. The cleaning blade 77 functions as a process device acting on the drum 62 together with the charging roller 66, the developing roller 32, and the transfer roller 7.

The Cartridge

Figure 10:
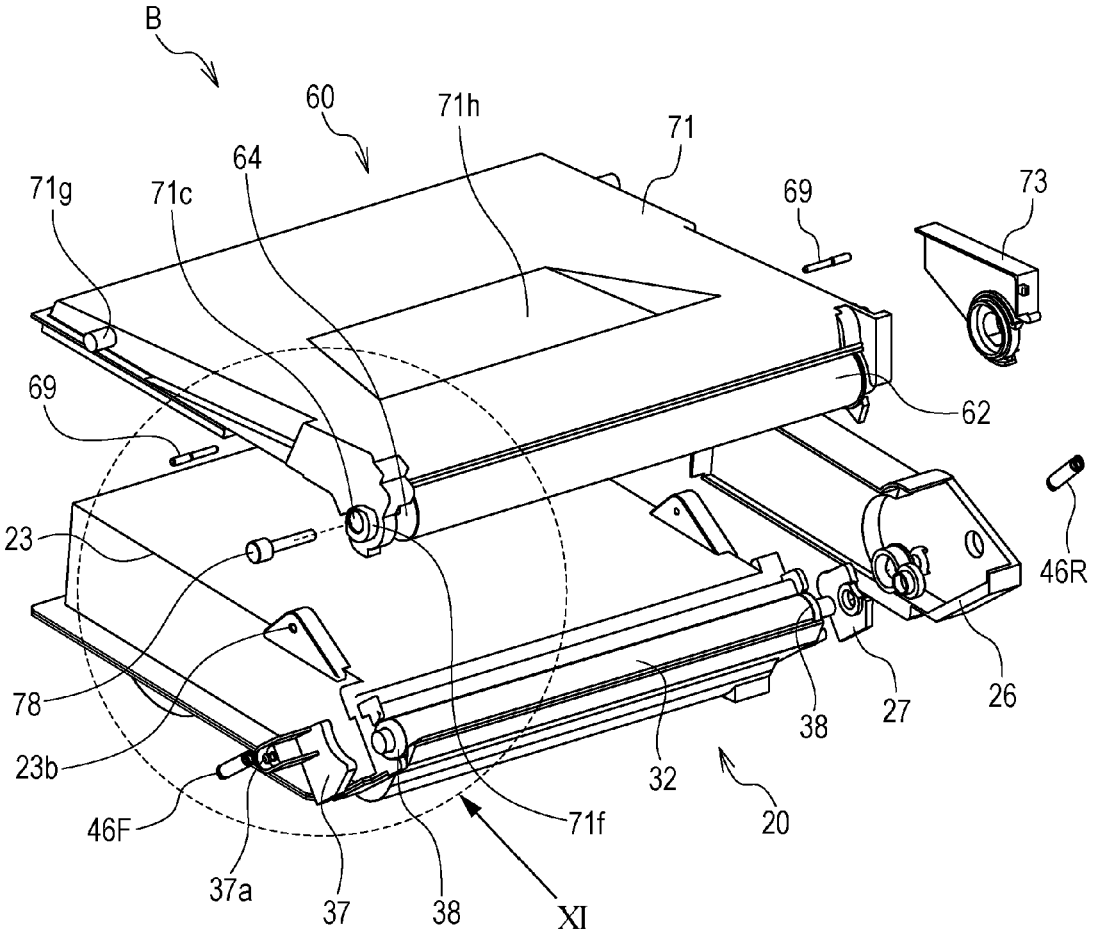
FIG. 10 is an exploded view of the process cartridge according to the embodiment.
Figure 11:
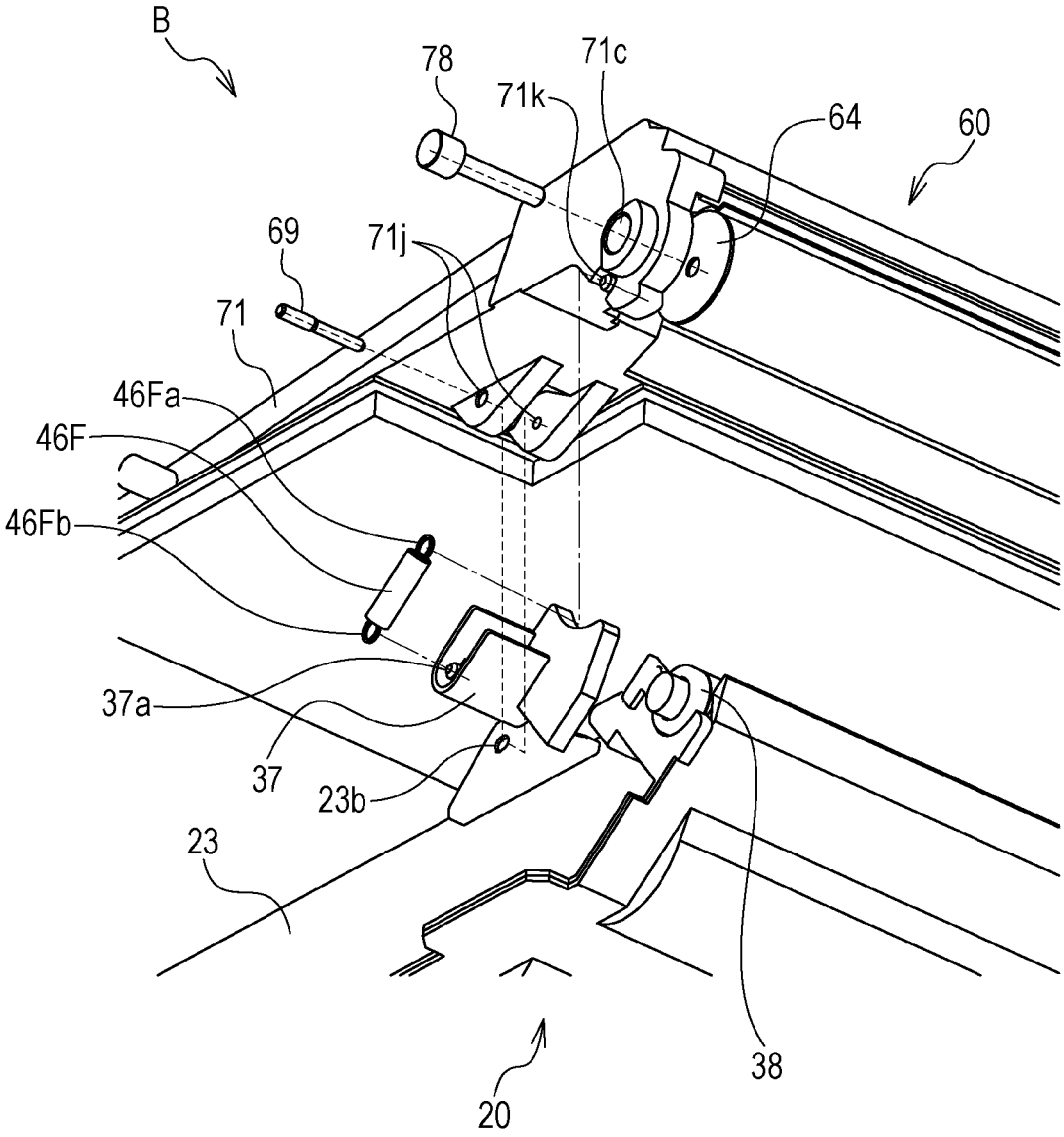
FIG. 11 is an enlarged view of part of the process cartridge according to the embodiment.
Figure 12:
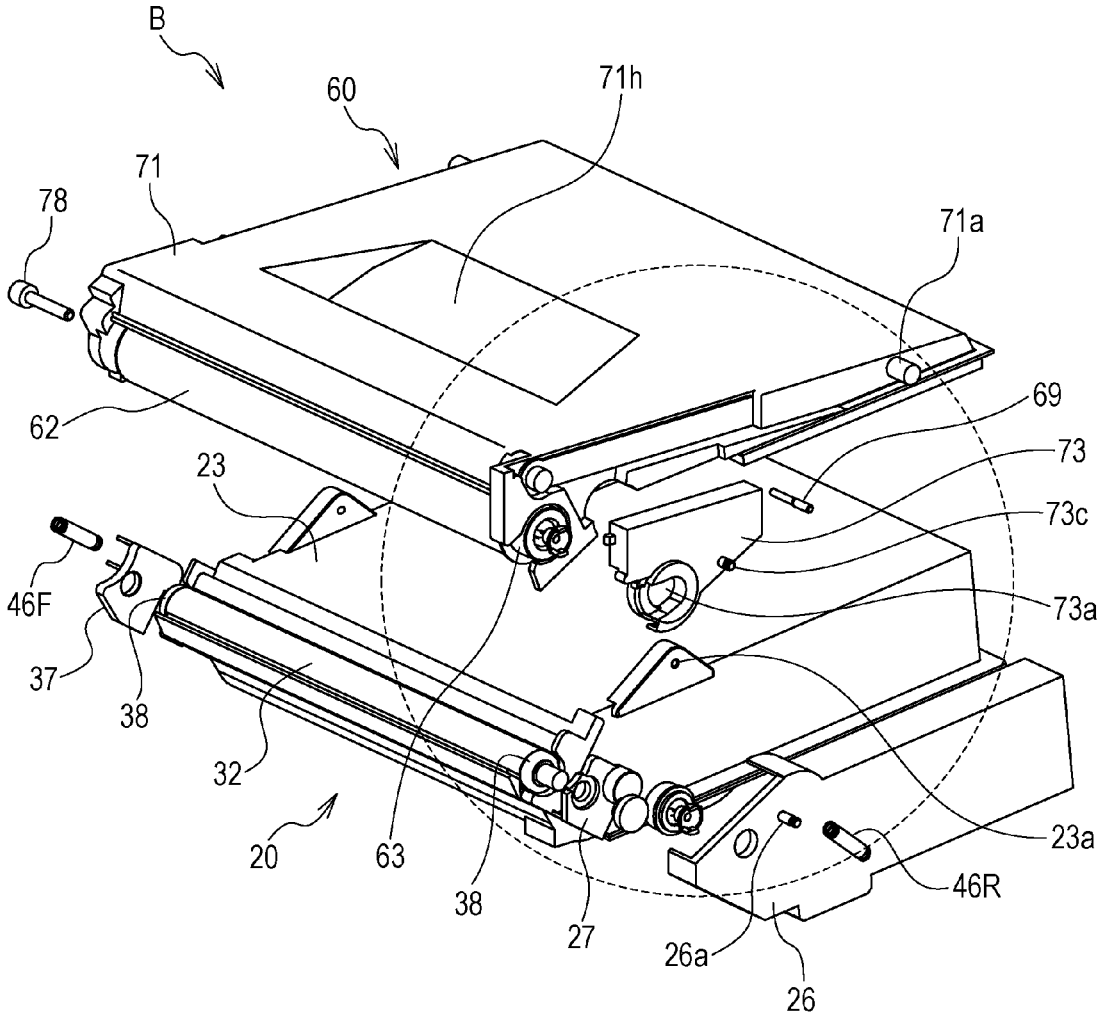
FIG. 12 is an exploded view of the process cartridge according to the embodiment.
Figure 13:
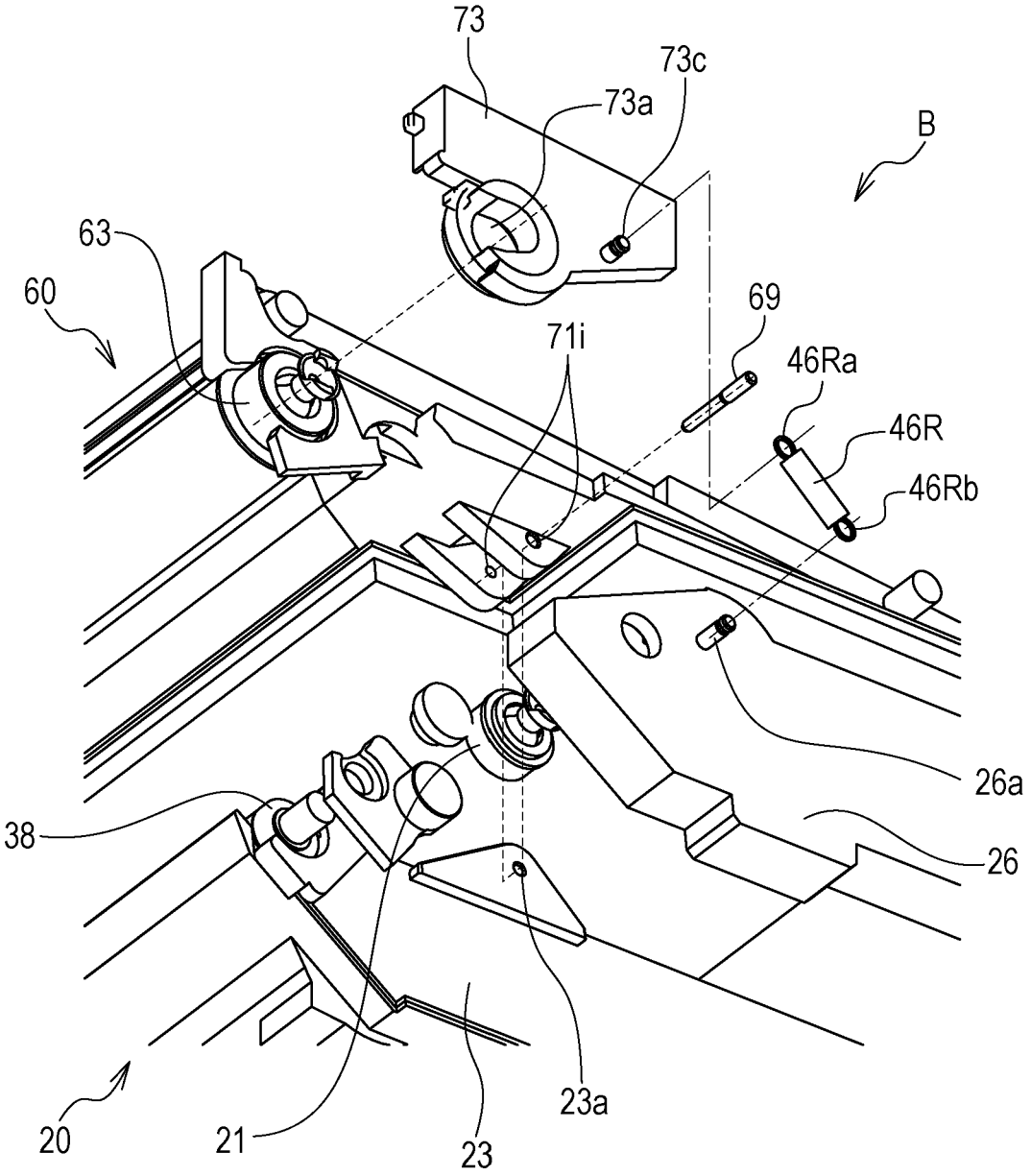
FIG. 13 is an enlarged view of part of the process cartridge according to the embodiment.

Next, an overall structure of the cartridge B serving as the process cartridge is described with reference to FIGS. 3, 4A, 4B, 10, 11, 12, and 13. FIG. 3 is a sectional view of the cartridge B. FIGS. 10, 11, 12, and 13 are perspective views illustrating the structure of the cartridge B. FIGS. 11 and 13 are enlarged views of parts of the cartridge B indicated by a dotted area XI of FIG. 10 and a dotted area of FIG. 12, respectively, seen at angles different from angles at which FIGS. 10 and 12 are seen. It is noted that description of screws used to connect each component are omitted from description of the present embodiment.

(1) The Cleaning Unit and the Developing Unit

Referring to FIG. 3, the cartridge B serving as the process cartridge includes the cleaning unit (image bearing member unit) 60 that includes (supports) the drum 62 and the developing unit 20 that includes (supports) the developing roller 32. As illustrated in FIGS. 10 and 12, the cleaning unit 60 and the developing unit 20 are integrated (connected) with each other so as to form the cartridge B.

In general, a process cartridge refers to a cartridge in which a drum (photosensitive member) and at least one of a charging device, a developing device, and a cleaning device that serve as process devices acting on the drum are provided together so as to be detachably attachable to a main body of an image forming apparatus. According to the present invention, the cartridge B serving as the process cartridge at least includes the cleaning unit 60.

(2) Coupling Members

Furthermore, the cartridge B according to the present embodiment includes coupling members (a first coupling 70 and a second coupling 21 illustrated in FIG. 8) on one of side surfaces. The coupling members connect (engage) the cartridge B to first and second drive members (a first drive shaft 14 and a second drive shaft 19 illustrated in FIG. 8) on the apparatus main body side.

(3) A Detailed Structure of the Cleaning Unit

The cleaning unit 60 includes the drum 62 illustrated in FIG. 3 and a drum bearing 73 and drum shaft 78 illustrated in FIG. 10. The drum 62 is rotatably supported by the drum bearing 73 and the drum shaft 78. As illustrated in FIG. 3, the cleaning unit 60 also includes the charging roller 66, the cleaning member 77, the cleaning frame 71, and a lid member 72. The cleaning frame 71 supports the charging roller 66 and the cleaning member 77. The lid member 72 is secured to the cleaning frame 71 by, for example, welding. The charging roller 66 and the cleaning member 77 are in contact with the outer circumferential surface of the drum 62 in the cleaning unit 60.

Referring to FIG. 3, the drum 62 receives the drive force from a main body drive motor (not illustrated) that serves as a drive source so as to be rotated in an arrow R direction of, for example, FIG. 3 corresponding to an image forming operation. That is, as illustrated in FIG. 13, the drum 62 is supported such that a drive-side drum flange 63 provided on the drive side is rotatably supported by a hole 73*a* of the drum bearing 73 on the drive side. Meanwhile, as illustrated in FIG. 11, a hole (not illustrated) of a non-drive-side drum flange 64 is rotatably supported by the drum shaft 78, which is press fitted into a hole 71*c* provided in the cleaning frame 71, on the non-drive side.

The charging roller 66 is rotatably attached to the cleaning unit 60 through charging roller bearings 67 at both end portions in the longitudinal direction of the cleaning frame 71 (substantially parallel to the rotational axis direction of the drum 62). The charging roller 66 is in pressure contact with the drum 62 by an urging member 68 that presses the charging roller bearings 67 toward the drum 62. The charging roller 66 is rotated by following the rotation of the drum 62.

The cleaning member 77 includes a rubber blade 77*a* and a support member 77*b*. The rubber blade 77*a* is a blade-shaped elastic member formed of a rubber serving as an elastic material. The support member 77*b* supports the rubber blade 77*a*. The rubber blade 77*a* is in contact with the drum 62 in a counter direction to the rotational direction of the drum 62. That is, the rubber blade 77*a* is in contact with the drum 62 such that a distal end portion of the rubber blade 77*a* faces an upstream side in the rotational direction of the drum 62.

Figure 4A:
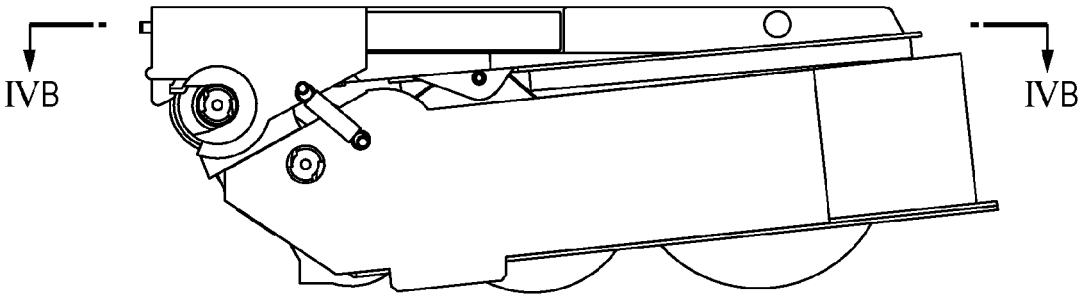
FIG. 4A is a side view of a cleaning container of the process cartridge according to the embodiment.
Figure 4B:
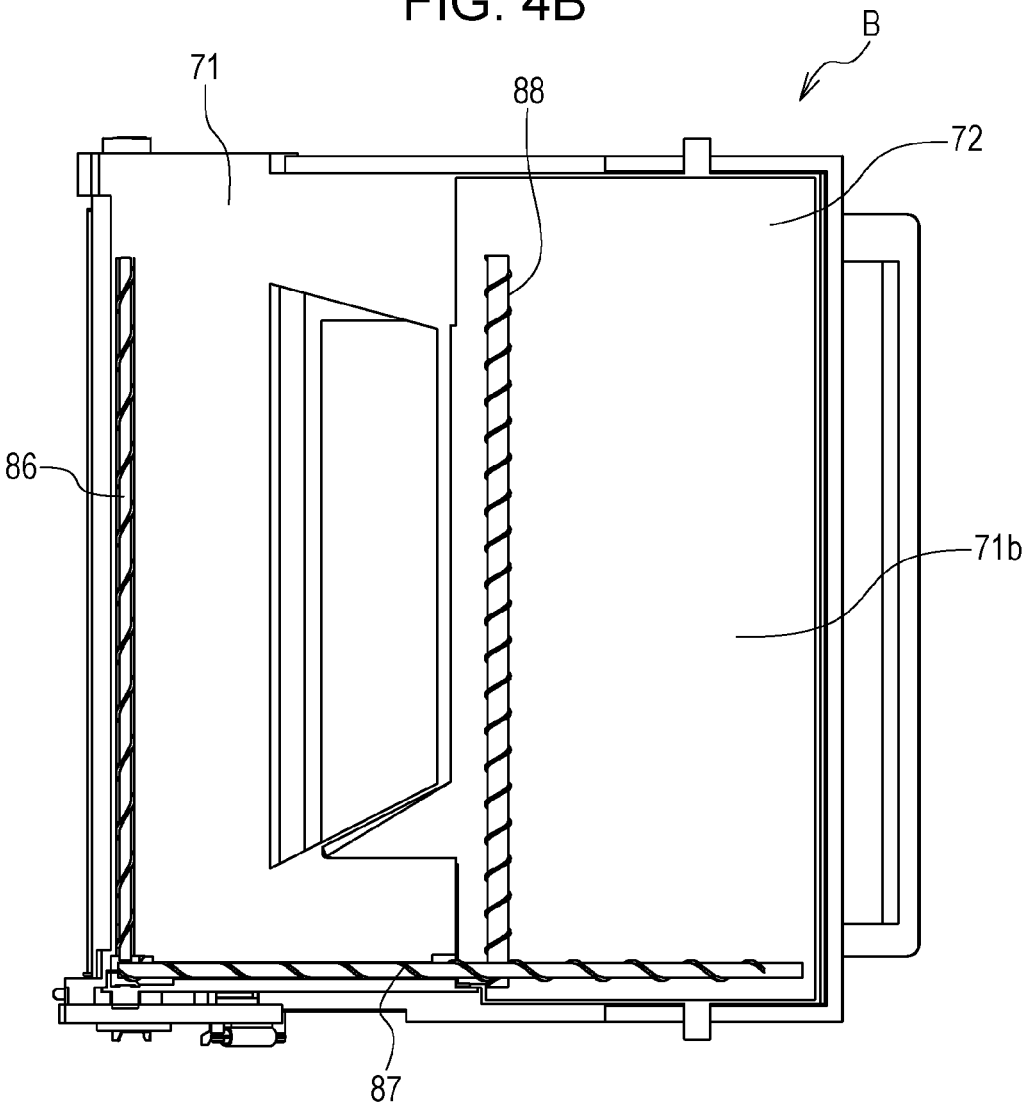
FIG. 4B is a sectional view of the interior of the cleaning container of the process cartridge according to the embodiment.

FIG. 4A is a side view of the cleaning frame 71, and FIG. 4B is a sectional view (plan view) taken along line IVB-IVB of FIG. 4A. As illustrated in FIGS. 3 to 4B, waste toner removed from the surface of the drum 62 by the cleaning member 77 is conveyed by a first screw 86, a second screw 87, and a third screw 88, which each serve as a waste toner conveyance member. The conveyed waste toner is accumulated in the waste toner chamber 71*b* formed by the cleaning frame 71 and the lid member 72.

Here, the first screw 86 is rotated by drive transmitted from the coupling 21 illustrated in FIG. 13 via a gear (not illustrated). The second screw 87 is rotated by a drive force received from the first screw 86, and the third screw 88 is rotated by the drive force received from the second screw 87. The first screw 86 is disposed near the drum 62, the second screw 87 is disposed at one of the end portions in the longitudinal direction of the cleaning frame 71, and the third screw 88 is disposed in the waste toner chamber 71*b*.

Rotational axes of the first screw 86 and the third screw 88 are parallel to the rotational axis of the drum 62. The rotational axis of the second screw 87 is perpendicular to the rotational axis of the drum 62. Furthermore, as illustrated in FIG. 3, a scooping sheet 65 that prevents leakage of the toner from the cleaning frame 71 is provided at an edge portion of the cleaning frame 71 so as to be in contact with the drum 62.

(4) A Detailed Structure of the Developing Unit

As illustrated in FIGS. 3, 10, and 12, the developing unit 20 includes the developing roller 32, a developing container 23, the developing blade 42, a bottom member 22, a drive-side developing side member 26, and so forth. The developing container 23 supports the developing roller 32. The developing blade 42 regulates a toner layer on the developing roller 32. The developing roller 32 is rotatably attached to the developing container 23 by bearing members 27 and 37 provided at both ends. Furthermore, the magnet roller 34 is provided in the developing roller 32.

Furthermore, gap maintaining members 38 are attached at both end portions of the developing roller 32 in the axial direction of the developing roller 32. The gap maintaining members 38 maintain a gap between the developing roller 32 and the drum 62. The gap maintaining members 38 are in contact with the drum 62 so as to hold the developing roller 32 while the small gap is maintained between the developing roller 32 and the drum 62.

Furthermore, as illustrated in FIG. 3, an anti-blowoff sheet 33 that prevents leakage of the toner from the developing unit 20 is provided at an edge portion of the bottom member 22 so as to be in contact with the developing roller 32. Furthermore, the first conveyance member 43, the second conveyance member 44, and the third conveyance member 50 are provided in the toner chamber 29 formed by the developing container 23 and the bottom member 22. The first conveyance member 43, the second conveyance member 44, and the third conveyance member 50 agitate the toner contained in the toner chamber 29 and convey the toner to the toner supply chamber 28.

(5) Relative Rotation of the Cleaning Unit and the Developing Unit

As illustrated in FIGS. 11 and 13, the cleaning unit 60 and the developing unit 20 are connected to each other by connecting pins 69 such that the cleaning unit 60 and the developing unit 20 are rotatable relative to each other. Specifically, a first developing support hole 23*a* (FIG. 13) and a second developing support hole 23*b* (FIG. 11) are provided at both the end portions of the developing container 23 in the longitudinal direction of the developing unit 20. Furthermore, first holes 71*i* (FIG. 13) and second holes 71*j* (FIG. 11) are provided in the cleaning frame 71 at end portions in the longitudinal direction of the cleaning unit 60.

The connecting pins 69 press fitted into and secured to the first holes 71*i* and the second holes 71*j* are fitted into the first developing support hole 23*a* and the second developing support hole 23*b*. Thus, the cleaning unit 60 and the developing unit 20 are connected so as to be rotatable relative to each other.

Furthermore, referring to FIG. 13, a first hole 46Ra of a drive-side urging member 46R is hooked onto a boss 73*c* of the drum bearing 73, and a second hole 46Rb of the drive-side urging member 46R is hooked onto a boss 26*a* of the drive-side developing side member 26. Furthermore, referring to FIG. 11, a first hole 46Fa of a non-drive-side urging member 46F is hooked onto a boss 71*k* of the cleaning frame 71, and a second hole 46Fb of the non-drive-side urging member 46F is hooked onto a boss 37*a* of the bearing member 37.

According to the present embodiment, the drive-side urging member 46R and the non-drive-side urging member 46F use extension springs. Due to urging forces of these springs, the developing unit 20 is urged toward the cleaning unit 60, thereby reliably pushing the developing roller 32 toward the drum 62. Furthermore, with the gap maintaining members 38 attached at both the end portions of the developing roller 32, the developing roller 32 is held with a specified gap maintained between the developing roller 32 and the drum 62.

Attachment and Detachment of the Cartridge

Figure 5:
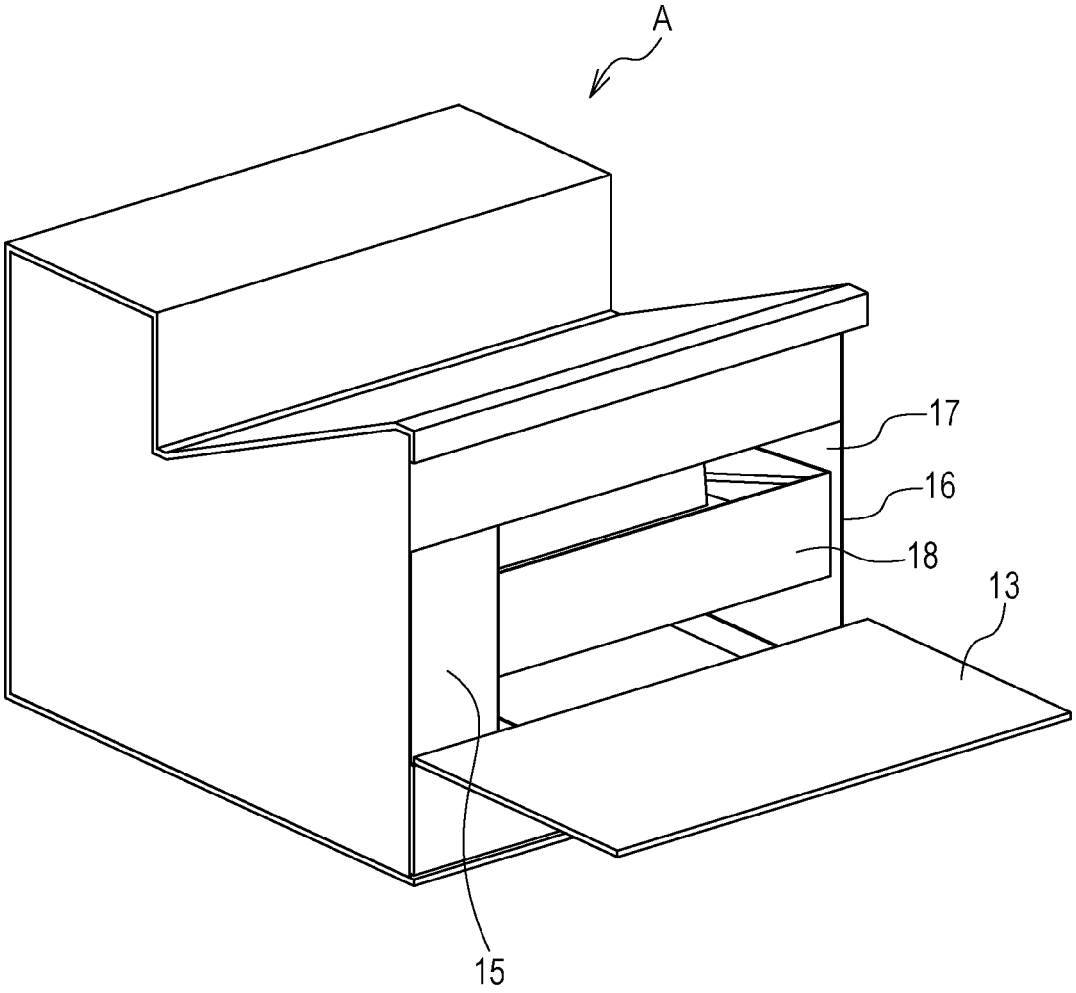
FIG. 5 is a perspective view of the image forming apparatus main body with the door of the image forming apparatus according to the embodiment opened.
Figure 6:
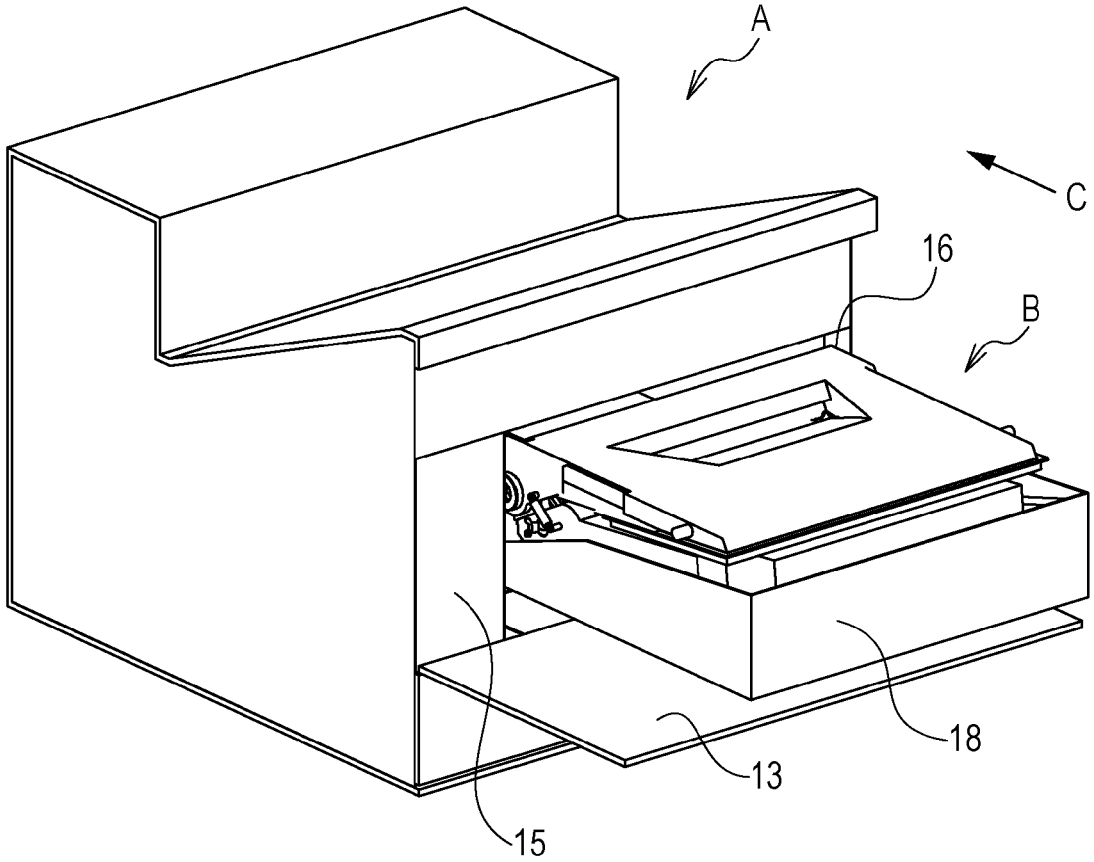
FIG. 6 is a perspective view of the image forming apparatus main body while the door is opened and the tray is drawn in the image forming apparatus according to the embodiment.
Figure 7:
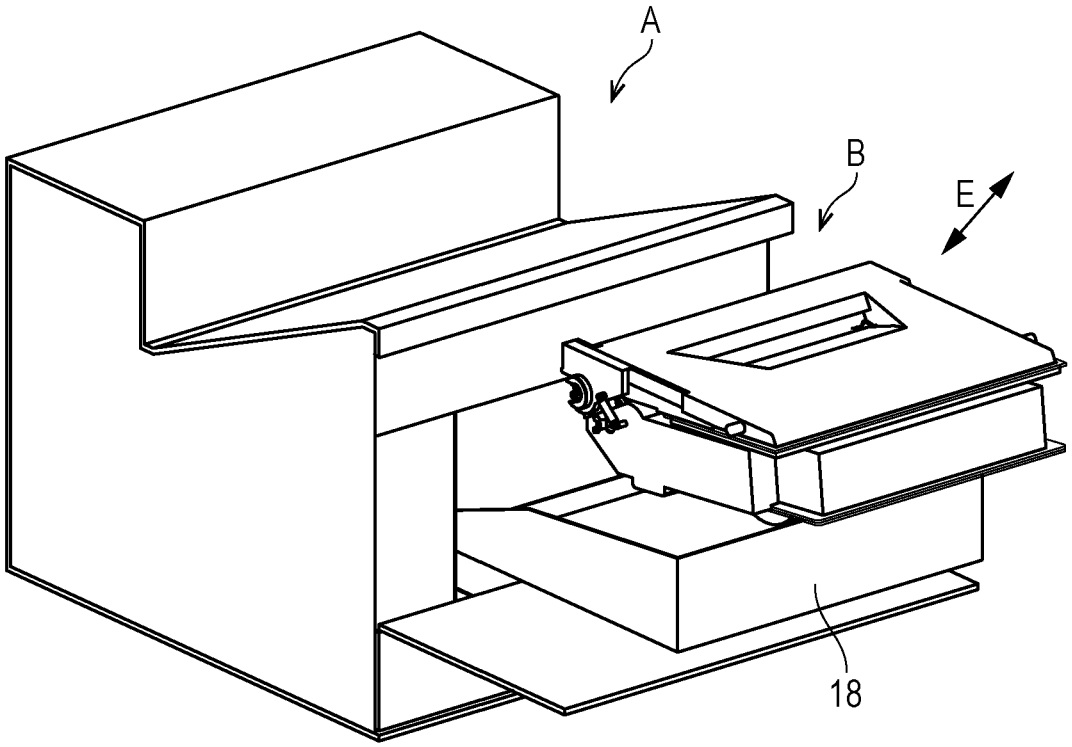
FIG. 7 is a perspective view of the image forming apparatus main body and the process cartridge during attachment or detachment of the process cartridge to or from the tray while the door is opened and the tray is drawn in the image forming apparatus according to the embodiment.

Next, attachment and detachment of the cartridge B to and from the apparatus main body A are described with reference to FIGS. 5 to 7. FIG. 5 is a perspective view of the apparatus main body A with a door 13 opened. FIG. 6 is a perspective view of the apparatus main body A and the cartridge B with the door 13 for attachment and detachment of the cartridge B opened and the tray 18 drawn. FIG. 7 is a perspective view of the apparatus main body A and the cartridge B during the attachment and detachment of the cartridge B with the door 13 opened and the tray 18 drawn. Referring to FIG. 7, the cartridge B is attachable to the tray 18 in an attachment direction E. The attachment direction E is a movement direction in which the tray 18 is moved from a second position to a first position.

Referring to FIG. 5, the door 13 is rotatably attached to the apparatus main body A. When the door 13 is opened, there is a cartridge insertion hole 17. The tray 18 for attaching the cartridge B to the apparatus main body A is provided in the cartridge insertion hole 17. FIG. 5 illustrates a state in which the tray 18 is attached in the apparatus main body A. In this state, the tray 18 is at the first position.

The tray 18 is movable relative to the apparatus main body A. FIG. 6 illustrates a state in which the tray 18 has been drawn to a specified position outside the apparatus main body A. In this state, the tray 18 is at the second position.

In the state illustrated in FIG. 6, the cartridge B is attachable to or detachable from the tray 18. When the cartridge B is replaced with a new cartridge B, the new cartridge B is being attached into the apparatus main body A along a guide rail (not illustrated) in an arrow C1 direction (FIG. 1) in a state in which the cartridge B is disposed on the tray 18. Then, the tray 18 is moved to the first position as illustrated in FIGS. 2 and 5 and attached to the apparatus main body A. In this state, the cartridge B attached to the tray 18 is disposed at a position where the cartridge B is usable for image formation.

Here, the first drive shaft (first drive member) 14 and the second drive shaft (second drive member) 19 that transmit the drive to the first coupling 70 and the second coupling 21 (FIG. 8) of the cartridge B are provided in the apparatus main body A. The first drive shaft 14 and the second drive shaft 19 are driven by the motor (not illustrated) of the apparatus main body A. Thus, the drum 62 coupled to the first coupling 70 is rotated by the drive force received from the apparatus main body A. Also, the developing roller 32 is rotated by the drive transmitted from the second coupling 21. Furthermore, power is supplied from a power supply unit (not illustrated) of the apparatus main body A to the charging roller 66 and the developing roller 32.

The first coupling 70 is a drive receiving member that is brought into engagement with the first drive shaft 14 so as to receive the drive force from the apparatus main body A, thereby rotating a rotating member (drum 62) provided in the cartridge B. Likewise, the second coupling 21 is a drive receiving member that is brought into engagement with the second drive shaft 19 so as to receive the drive force from the apparatus main body A, thereby rotating a rotating member (developing roller 32) provided in the cartridge B. There are rotating members rotated by the drive force received by the second coupling 21 other than the developing roller 32. The other rotating members include, as described above, the first screw 86, the second screw 87, and the third screw 88.

The detailed shapes of the first coupling 70, the second coupling 21, the first drive shaft 14, and the second drive shaft 19 will be described later.

Supports for the Cartridge

Figure 8:
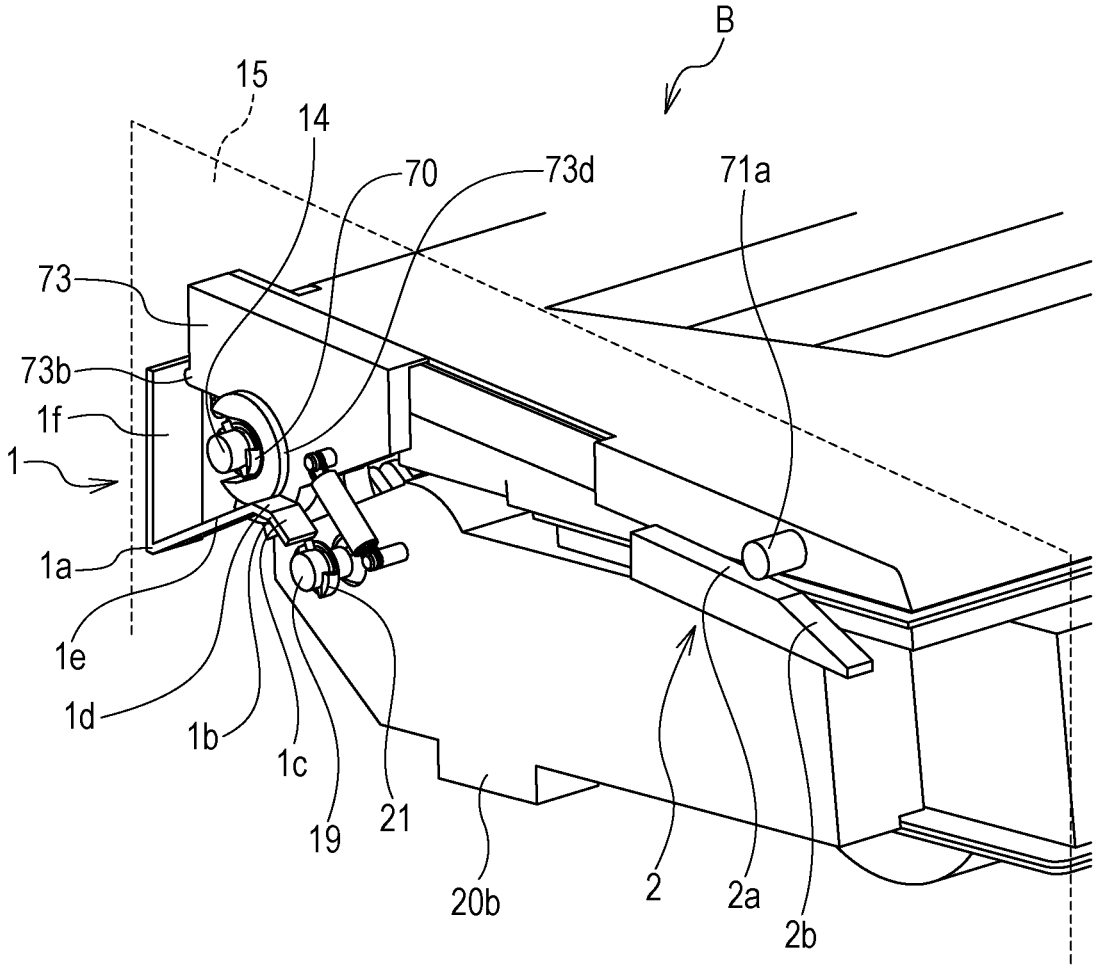
FIG. 8 is a perspective view of the process cartridge and a drive-side positioning portion of the image forming apparatus main body when the process cartridge is attached to the image forming apparatus main body according to the embodiment.

As illustrated in FIG. 5, a drive-side plate 15 and a non-drive-side plate 16 that support the cartridge B are provided in the apparatus main body A. As illustrated in FIG. 8, the drive-side plate 15 is provided with a drive-side support portion 1 and a drive-side rotation support portion 2 that each serve as a support member for the cartridge B. A support portion 1*a* and a first guide portion 1*b* serving as an upwardly inclined surface portion are integrally formed in the drive-side support portion 1. A rotation support surface 2*a* and a second guide portion 2*b* are integrally formed in the drive-side rotation support portion 2. The support portion 1*a* has a support surface 1*f* serving as a positioning surface portion and a support surface 1*e* serving as a downwardly inclined surface portion. The first guide portion 1*b* has a guide surface 1*c* and a guide surface 1*d* serving as a flat surface portion.

Figure 9:
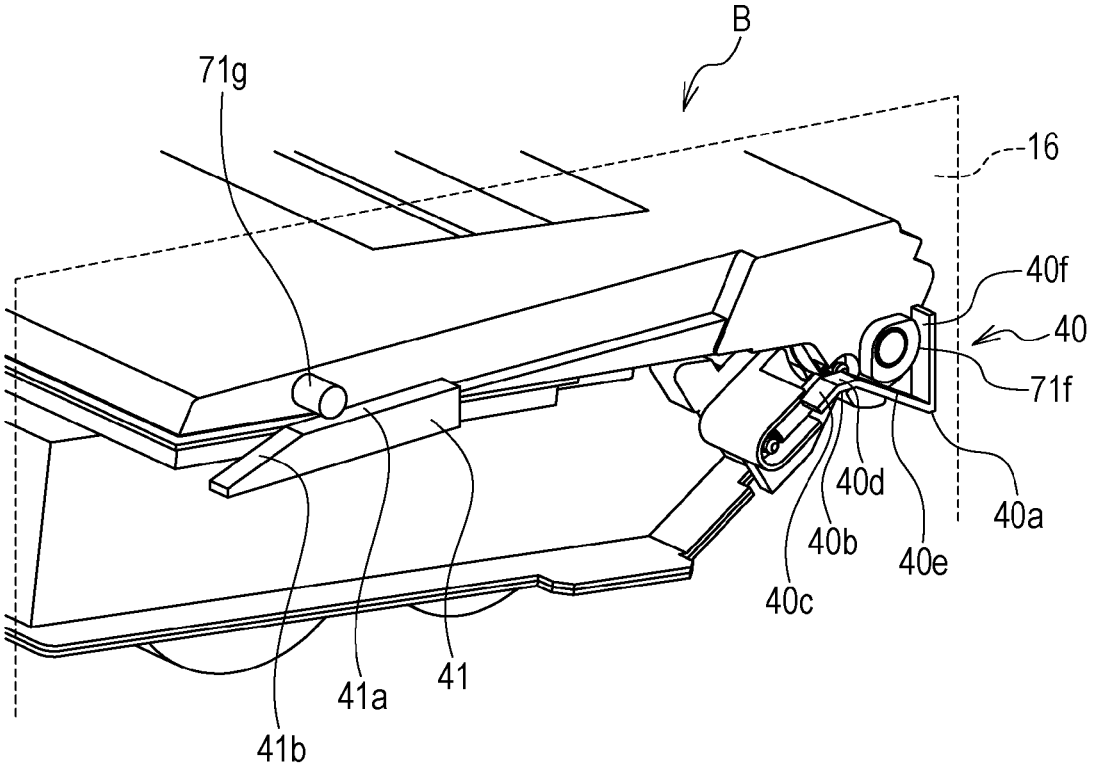
FIG. 9 is a perspective view of the process cartridge and a non-drive-side positioning portion of the image forming apparatus main body when the process cartridge is attached to the image forming apparatus main body according to the embodiment.

Likewise, as illustrated in FIG. 9, the non-drive-side plate 16 is provided with a non-drive-side support member 40 and a non-drive-side rotation support member 41. A support portion 40*a* and a first guide portion 40*b* are integrally formed in the non-drive-side support member 40. A rotation support portion 41*a* and a second guide portion 41*b* are integrally formed in the non-drive-side rotation support member 41. Referring to FIG. 9, the support surface 40*a* has support surfaces 40*f* and 40*e*, and the first guide portion 40*b* has guide surfaces 40*c* and 40*d*.

Meanwhile, as supported portions of the cartridge B, a supported portion 73*b* (FIG. 8) and a supported portion 73*d* (FIG. 8), which are provided in the drum bearing 73, and a non-drive-side projection 71*f* (FIG. 9) are provided. Furthermore, a drive-side boss 71*a* (FIG. 8) and a non-drive-side boss 71*g* (FIG. 9) which serve as rotation supported portions are provided in the cleaning frame 71.

Referring to FIG. 8, the supported portion 73*b* and the supported portion 73*d* are respectively supported by the support surface 1*f* and the support surface 1*e*, and the drive-side boss 71*a* is supported by the rotation support surface 2*a*. Likewise, referring to FIG. 9, the non-drive-side projection 71*f* is supported by the first non-drive-side support portion 40*f* and the second non-drive-side support portion 40*e*, and the non-drive-side boss 71*g* is supported by the rotation support portion 41*a*. Thus, the cartridge B is positioned and supported in the apparatus main body A.

Attachment of the Cartridge to the Tray and Support for the Cartridge

Figure 1:
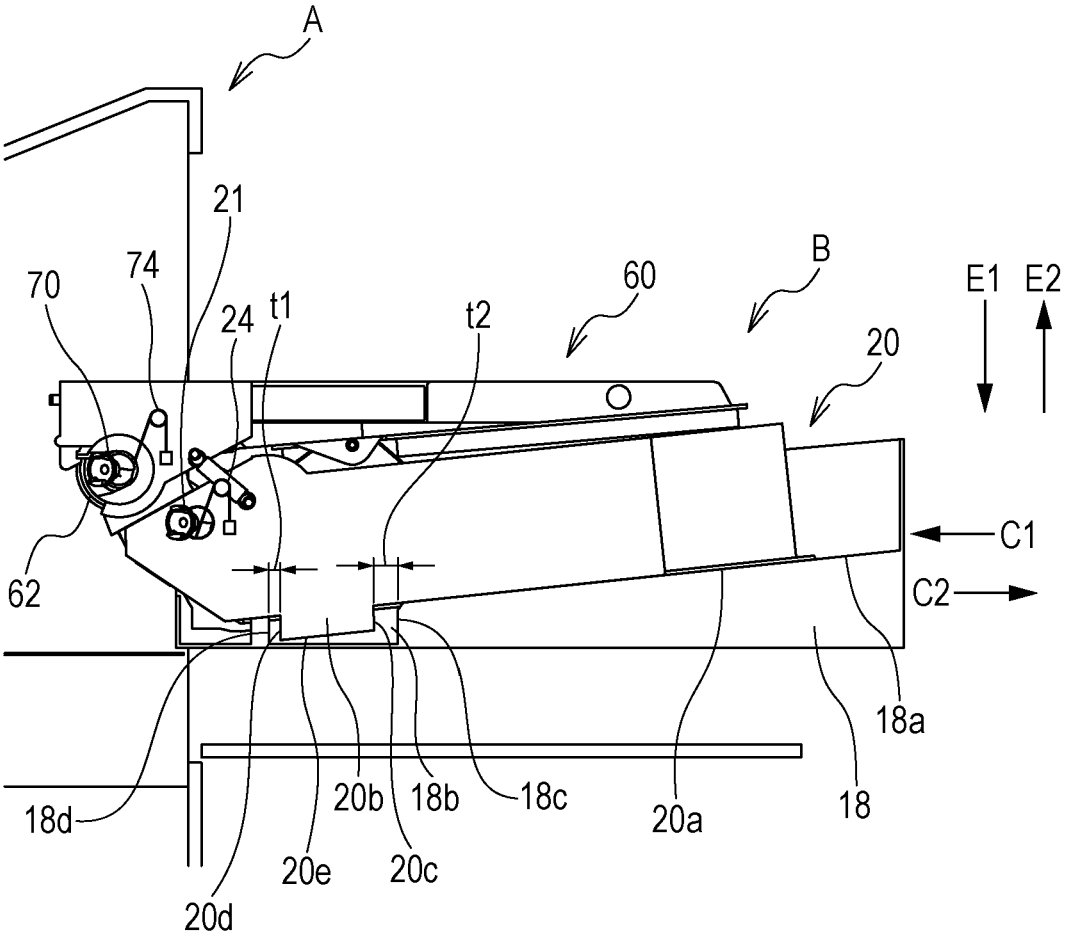
FIG. 1 is a sectional view of an image forming apparatus main body of an image forming apparatus according to an embodiment of the present invention to which a process cartridge is attached to a tray with a door of the image forming apparatus main body opened.
Figure 14:
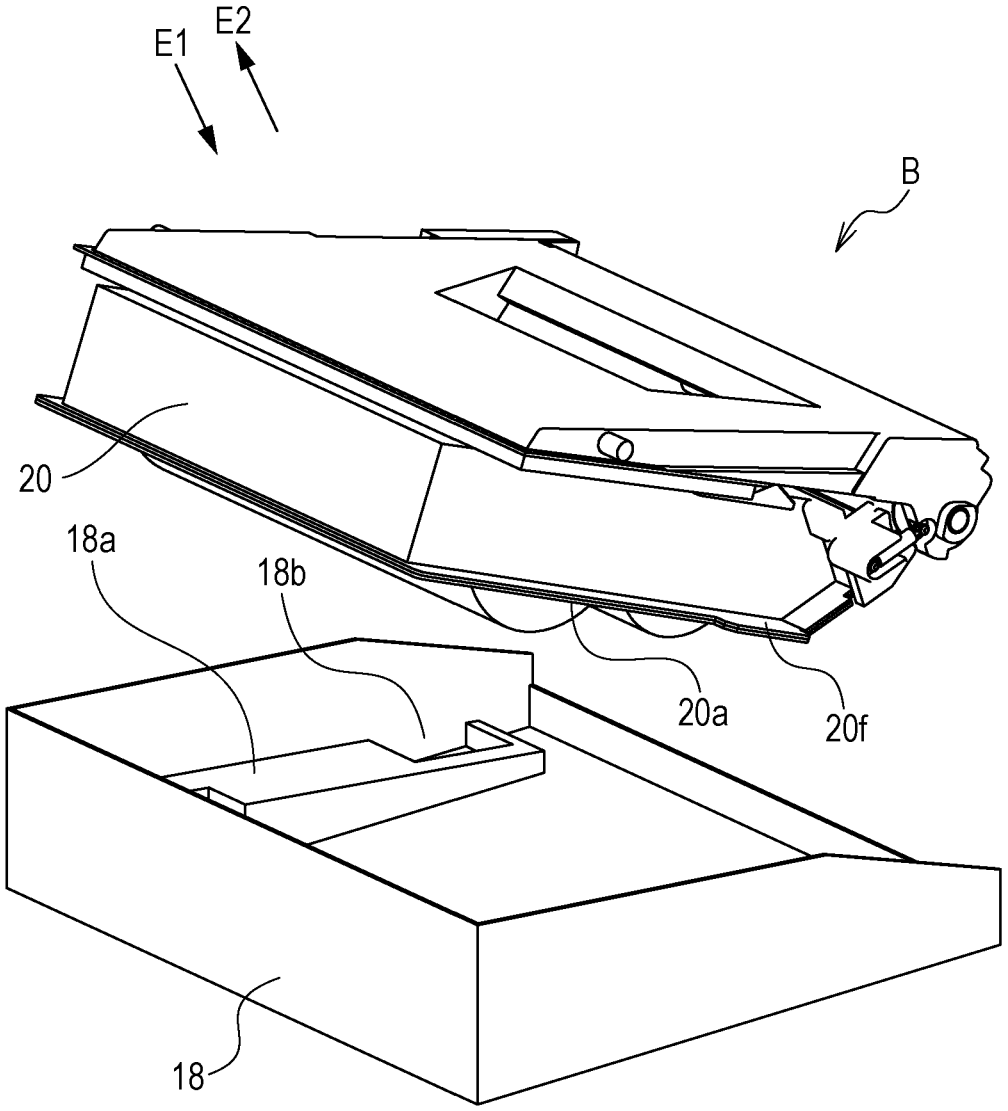
FIG. 14 is a perspective view of a state in which the process cartridge according to the embodiment is being attached to the tray.
Figure 15:
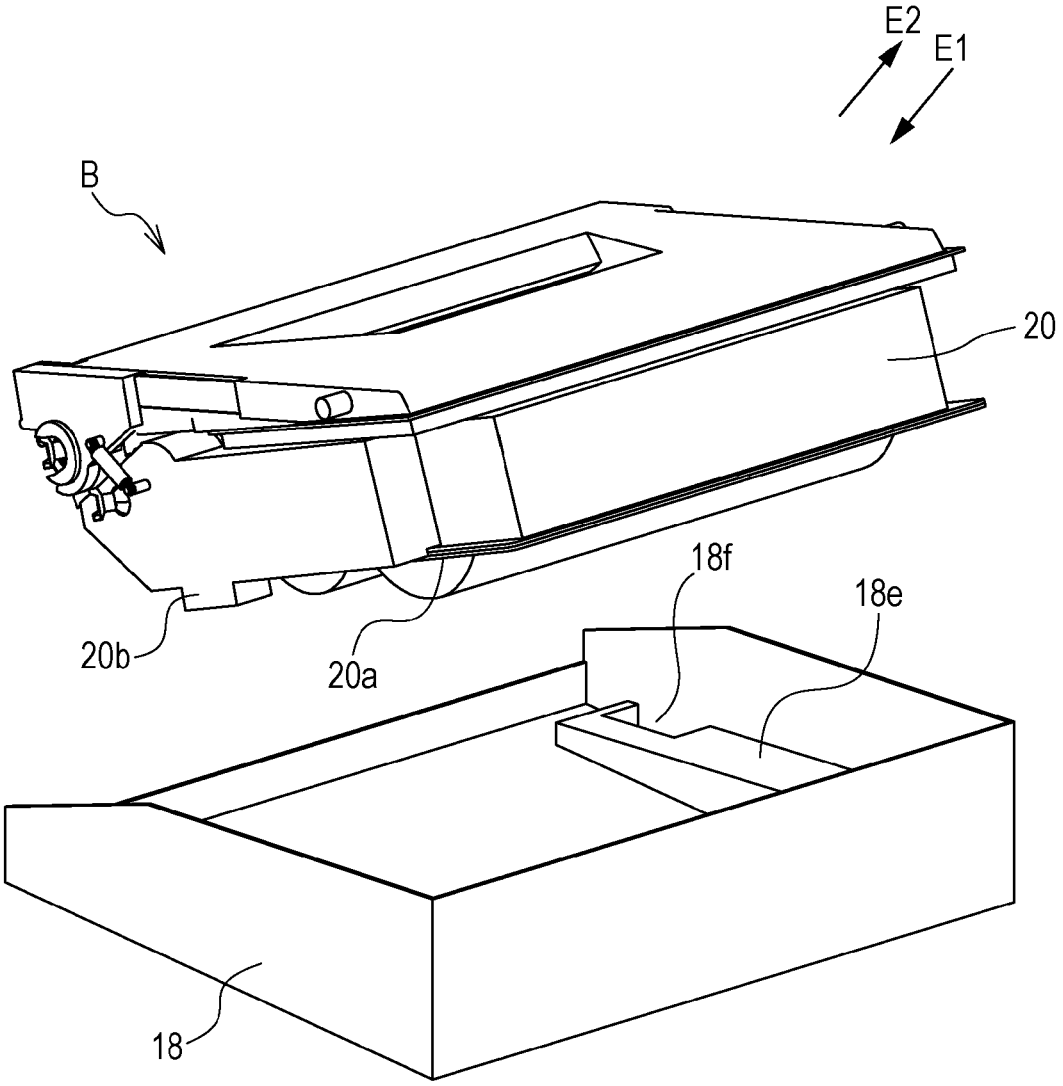
FIG. 15 is a perspective view of a state in which the process cartridge according to the embodiment is being attached to the tray.
Figure 16:
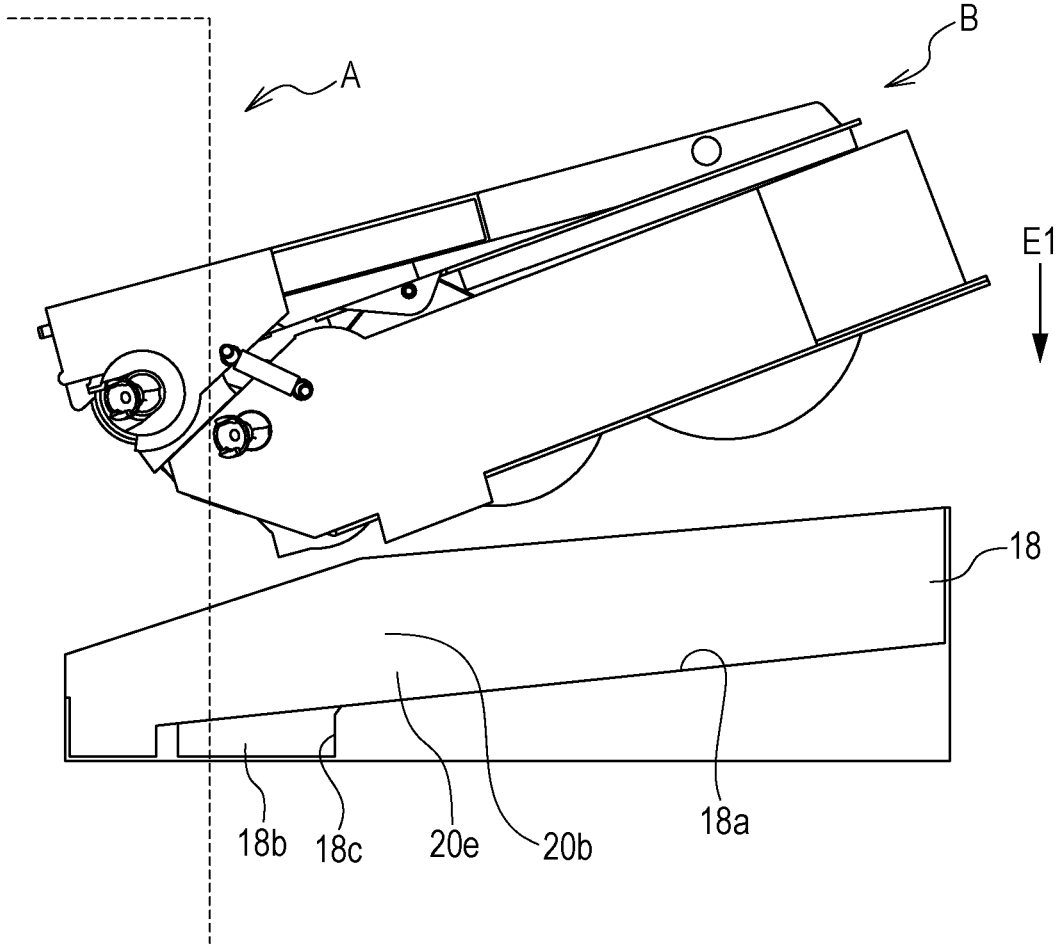
FIG. 16 is a sectional view of the tray in a state in which the process cartridge according to the embodiment is being attached to the tray.

As described above, when the cartridge B is attached to or detached from the apparatus main body A, the cartridge B is attached to the tray 18. Initially, attachment and detachment of the cartridge B to and from the tray 18 are described with reference to FIGS. 1, 14, 15, and 16. FIGS. 14 and 15 are perspective views illustrating the attachment and the detachment of the process cartridge B to the tray 18. FIG. 16 is a schematic view illustrating an attachment state of the cartridge B to the tray 18. FIG. 1 is a schematic view illustrating a state of the cartridge B attached to the tray 18 and disposed at an attachment position.

The tray 18 is provided with support surfaces 18*a* (FIG. 14) and 18*e* (FIG. 15) that support a supported surface 20*a* provided in the developing unit 20 of the cartridge B. The tray 18 is also provided with position regulating portions 18*b* (FIG. 14) and 18*f* (FIG. 15) that regulate position regulated portions 20*b* (FIG. 15) and 20*f* (FIG. 14). Description of the position regulating portion 18*f*, which has a structure similar to or the same as that of the position regulating portion 18*b*, is omitted.

FIG. 16 illustrates a state in which the door 13 (see FIG. 6) is opened and the tray 18 is at the attachment position (second position). In this state, part of the tray 18 is outside the apparatus main body A and the cartridge B is attachable to and detachable from the tray 18. When the user holds a handle (not illustrated) and moves the cartridge B in an arrow E1 direction of FIG. 16, the cartridge B is attached to the tray 18 in the arrow E1 direction of FIG. 16. Then, as illustrated in FIG. 1, the position regulated portion 20*b* of the cartridge B is positioned in a groove formed by the position regulating portion 18*b* and the supported surface 20*a* is supported by the support surface 18*a*. Thus, attachment of the cartridge B to the tray 18 is completed.

Since the position regulated portion 20*b* of the cartridge B is inside the position regulating portion 18*b* of the tray 18, a movement of the cartridge B relative to the tray 18 is suppressed (the movement is regulated). Thus, even when the tray 18 is moved, a state of the cartridge B attached inside the tray 18 is maintained. The position regulated portion 20*b* is a projection (third projection) projecting downward from the developing unit 20 of the cartridge B. A direction in which the position regulated portion 20*b* projects intersects the longitudinal directions (axial directions) of the drum 62 and the developing roller 32.

In contrast, in order to detach the cartridge B from the tray 18, the cartridge B is detached from the tray 18 by holding the handle (not illustrated) and moving the cartridge B in an arrow E2 direction of FIG. 1.

Orientations of the Couplings During Attachment of the Cartridge to the Apparatus Main Body Next, orientations of the couplings during attachment of the cartridge B to the apparatus main body A are described. As has been described, the drive-side plate 15 of the apparatus main body A is provided with the drive-side support portion 1 and the drive-side rotation support portion 2 as illustrated in FIG. 8. The non-drive-side plate 16 is provided with the non-drive-side support member 40 and the non-drive-side support member 41 as illustrated in FIG. 9. Since the functions of these members on the drive side are the same or similar to those on the non-drive side, the following description is dedicated to the structure on the drive side.

FIG. 1 illustrates the state of the cartridge B attached to the tray 18. By contact of the support surface 18*a* of the tray 18 with the supported surface 20*a* of the developing unit 20, the cartridge B is supported relative to the tray 18. Here, the position regulated portion 20*b* provided on a bottom surface of the developing unit 20 includes a first contacted surface 20*c* and a second contacted surface 20*d*.

When the cartridge B is attached to the tray 18, a gap t2 is formed between a first contact surface 18*c* and the first contacted surface 20*c* and a gap t1 is formed between a second contact surface 18*d* and the second contacted surface 20*d*. Thus, the cartridge B is movable relative to the tray 18 by a distance corresponding to the gap t1 in the arrow C1 direction and by a distance corresponding to the gap t2 in an arrow C2 direction. The arrow C1 direction and the arrow C2 direction intersect the rotational axes (longitudinal directions, rotational axis directions) of the drum 62 and the developing roller 32.

Figure 17:
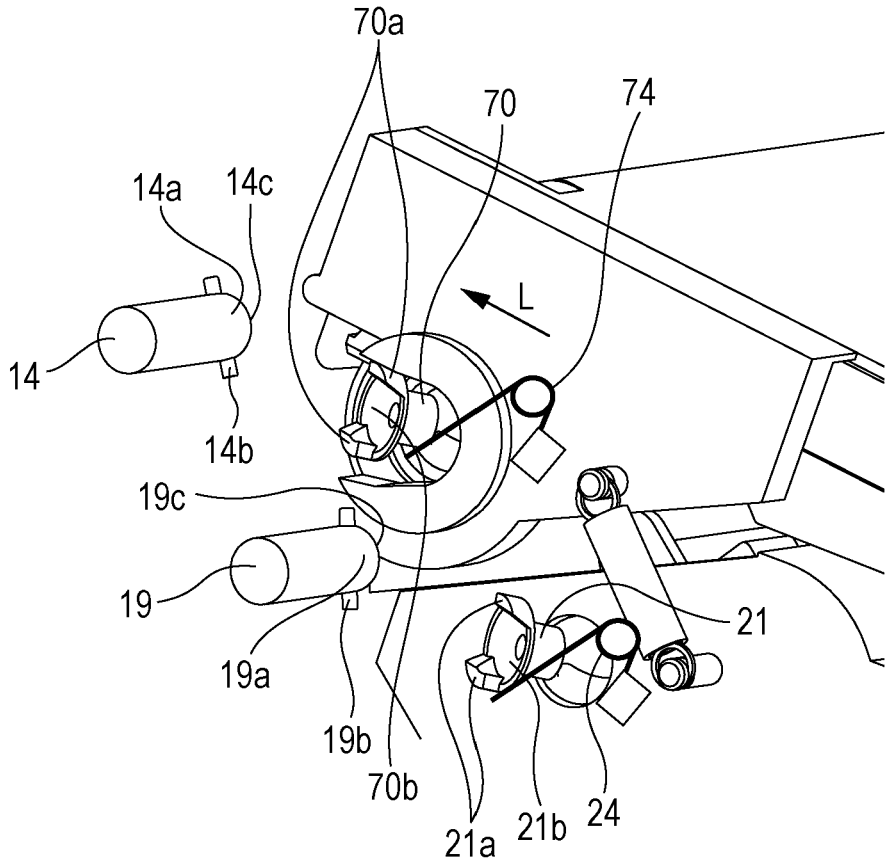
FIG. 17 is a perspective view of a state in which couplings of the process cartridge according to the embodiment are being brought into engagement with drive shafts of the main body.

Here, as illustrated in FIG. 17, the first drive shaft 14 and the second drive shaft 19 are provided near a side surface of the apparatus main body A. The first drive shaft 14 and the second drive shaft 19 include main-body-side engagement portions 14*a* and 19*a*. The main-body-side engagement portions 14*a* and 19*a* include pins 14*b* and 19*b* and distal end portions 14*c* and 19*c*, which serve as rotational force applying portions. The cartridge B includes the first coupling 70 and the second coupling 21. The first coupling 70 and the second coupling 21 include projections 70*a* and 21*a* and receiving surfaces 70*b* and 21*b*, which serve as rotational force receiving portions.

When the tray 18 is at an image forming position (position inside the apparatus main body A), the first coupling 70 and the second coupling 21 assume first orientations in which the first coupling 70 and the second coupling 21 are engaged with the main-body-side engagement portions 14*a* and 19*a* while the rotational axes of the first coupling 70 and the second coupling 21 are substantially parallel to the rotational axis of the drum 62. When the first orientations are assumed, the drive forces are transmitted to the rotating members (first drive position, second drive position).

However, while the tray 18 is being moved from an attachment and detachment position (position outside the apparatus main body A) to the image forming position (position inside the apparatus main body A), the first coupling 70 and the second coupling 21 are oriented as follows. That is, the orientations of the first coupling 70 and the second coupling 21 are second orientations (first inclined position, second inclined orientation) in which the first coupling 70 and the second coupling 21 are inclined such that a distal end sides of the rotational axes of the first coupling 70 and the second coupling 21 are positioned downstream of proximal end portion sides of the rotational axes of the first coupling 70 and the second coupling 21 in an attachment direction of the tray 18 (movement direction from the second position to the first position). That is, the distal end portions of the first coupling 70 and the second coupling 21 are disposed further to the downstream side in the attachment direction when the first coupling 70 and the second coupling 21 assume the second orientations than when the first coupling 70 and the second coupling 21 assume the first orientations.

When this change is described with reference to FIG. 17, the first coupling 70 and the second coupling 21 are inclined in an arrow L direction (downstream side in the attachment direction) due to urging forces of urging members 74 and 24.

Attachment of the Cartridge B to the Apparatus Main Body

Next, the attachment of the cartridge B to the apparatus main body A is described. Here, a state is assumed in which, as has been described with reference to FIG. 1, the position regulated portion 20*b* of the cartridge B is positioned at the position regulating portion 18*b* of the tray 18 and the supported surface 20*a* is supported by the support surface 18*a* (FIG. 14) of the tray 18. That is, it is assumed that the attachment of the cartridge B to the tray 18 is completed.

(1) Contact of the Supported Portion 73*d* with the Support Surface 1*c*

Figure 18A:
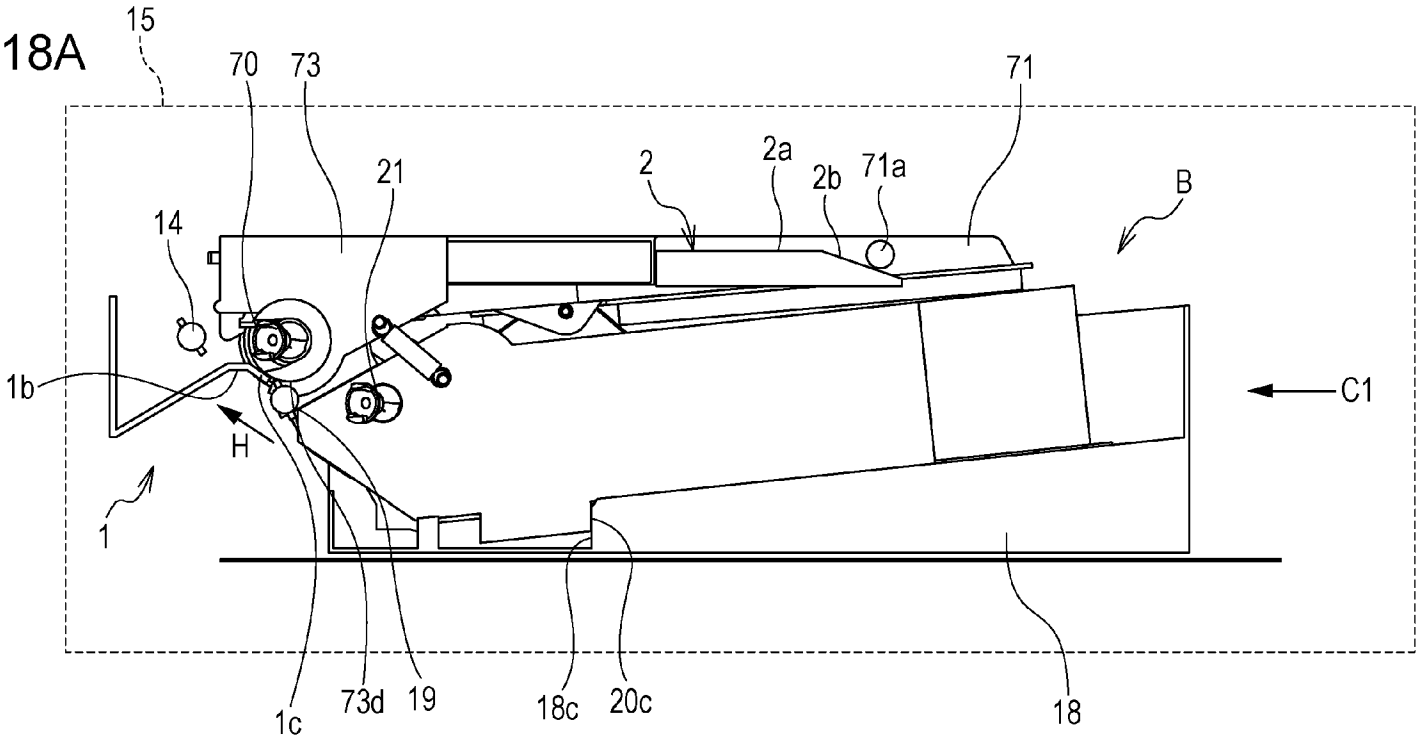
FIG. 18A is a sectional view of the tray in a state in which the process cartridge according to the embodiment is being attached to the tray (upwardly inclined surface portion)
Figure 18B:
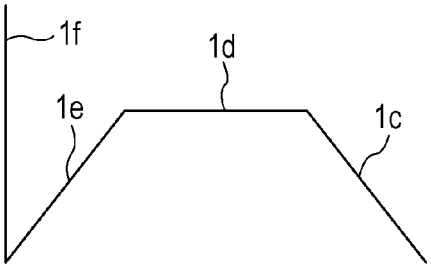
FIG. 18B is a sectional view of a drive-side support portion.

When the tray 18 is pushed in the arrow C1 direction of FIG. 1, the first contact surface 18*c* provided in the tray 18 is brought into contact (gap t2 is zero) with the first contacted surface 20*c* of the developing unit 20. This moves the process cartridge B in the arrow C1 direction of FIG. 1 due to a force from the tray 18. As illustrated in FIG. 18A, this causes the supported portion 73*d* of the drum bearing 73 and the drive-side boss 71*a* of the cleaning frame 71 to be brought into contact with the guide surface 1*c* provided in the drive-side support portion 1 and the guide portion 2*b* provided in the drive-side rotation support portion 2.

That is, since the first contact surface 18*c* and the first contacted surface 20*c* are in contact with each other, the cartridge B attempts to move in the C1 direction together with the tray 18 when the tray 18 is moved in the arrow C1 direction of FIG. 18A. However, the supported portion 73*d* and the drive-side boss 71*a* of the cartridge B are guided by the guide surface 1*c* and the guide surface 2*b*, which are the upwardly inclined surfaces, of the apparatus main body A. The guide surface 1*c* and the guide surface 2*b* are substantially parallel to each other and upwardly inclined in an advancing direction relative to the arrow C1 direction. This allows the guide surface 1*c* and the guide surface 2*b* to guide the cartridge B in an arrow H direction (inclined surface direction).

Thus, support for the cartridge B is changed from the support surface 18*a* provided in the tray 18 to the drive-side support portion 1 and the drive-side rotation support portion 2 (change in the support members for cartridge B). Thus, the cartridge B is moved in the arrow H direction of FIG. 18A different from the arrow C1 direction of FIG. 18A. At this time, the supported surface 20*a* is about to be brought out of contact from the support surface 18*a* in FIG. 1 due to an upward component of the arrow H direction.

(2) Contact of the Supported Portion 73*d* with the Support Surface 1*d*

Figure 19:
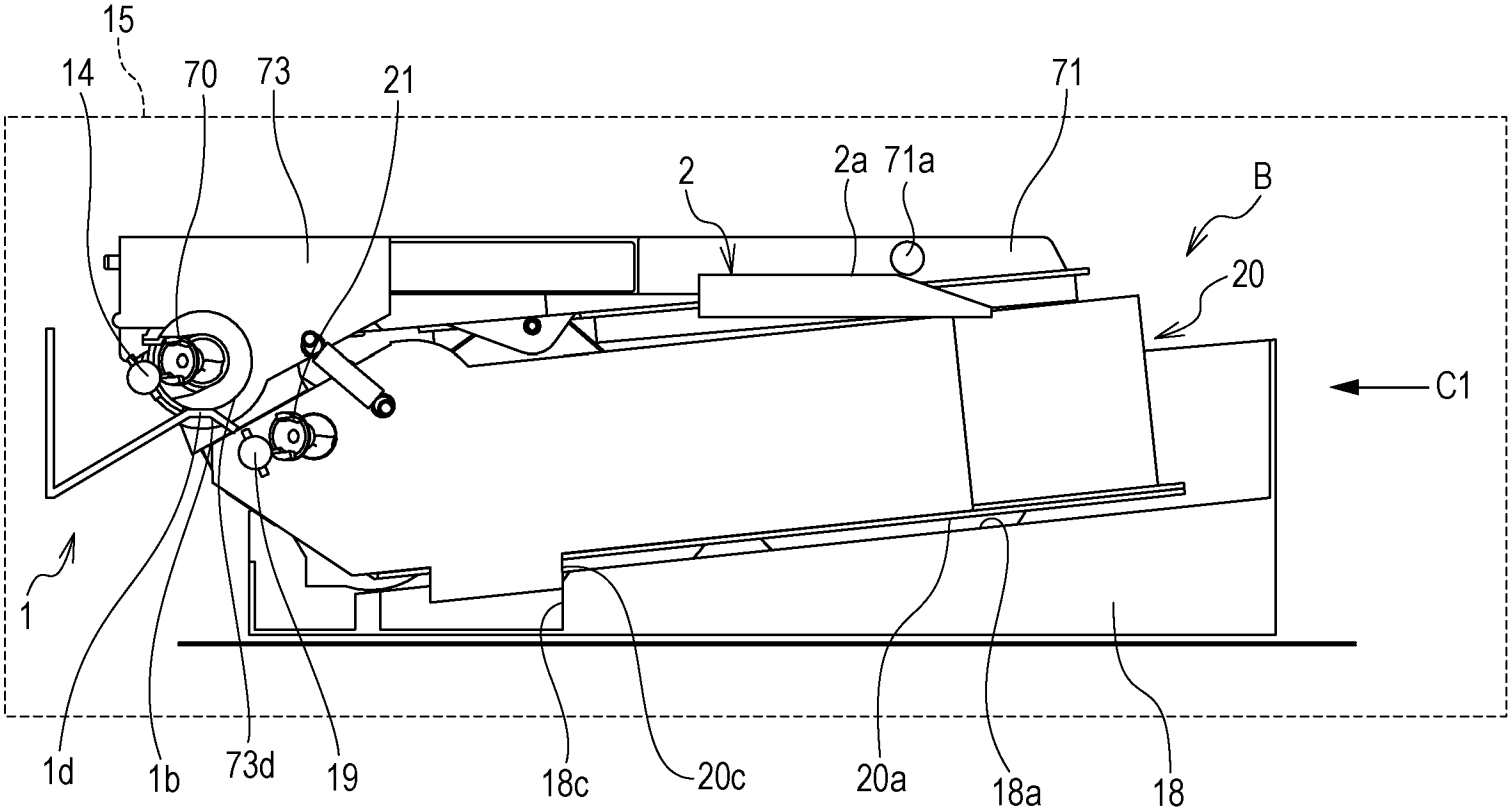
FIG. 19 is a sectional view of the tray in a state in which the process cartridge according to the embodiment is being attached to the tray (flat surface portion).

When the tray 18 is further moved in the arrow C1 direction, as illustrated in FIG. 19, the supported portion 73*d* of the drum bearing 73 and the drive-side boss 71*a* of the cleaning frame 71 are supported in the horizontal direction by the guide surface 1*d* and the rotation support surface 2*a* provided in the drive-side support portion 1 and the drive-side rotation support portion 2. At this time, the supported surface 20*a* is sufficiently brought out of contact from the support surface 18*a* due to accumulated effects of the upward component of the arrow H direction. The first contact surface 18*c* provided in the tray 18 and the first contacted surface 20*c* of the developing unit 20 are kept in contact with each other.

The cartridge B, which is released from the tray 18 in a direction (up-down direction) intersecting a tray displacement direction as described above, is supported in the horizontal direction by the support surface 1*d* of the drive-side support portion 1 and the rotation support surface 2*a* of the drive-side rotation support portion 2. In this state, the first contact surface 18*c* and the first contacted surface 20*c* are kept in contact with each other in the horizontal direction. Thus, when the tray 18 is moved in the C1 direction of FIG. 19 by the user, the cartridge B is also moved in the arrow C1 direction parallel to the support surface 1*d* and the rotation support surface 2*a* while being released from the tray 18 in the up-down direction.

(3) Contact of the Supported Portion 73*d* with the Support Surface 1*e*

Figure 20:
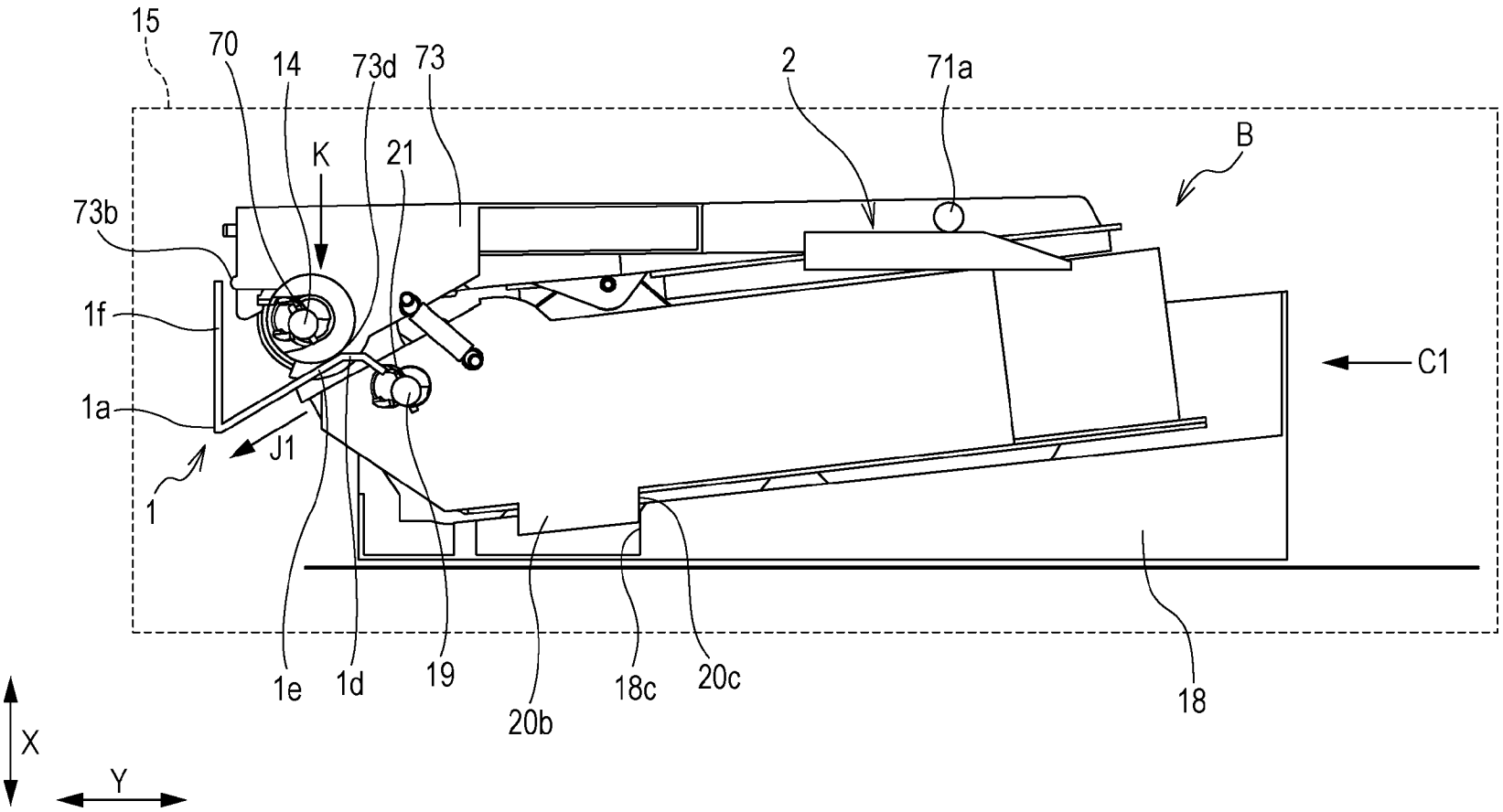
FIG. 20 is a sectional view of the tray in a state in which the process cartridge according to the embodiment is being attached to the tray (downwardly inclined surface portion).

Next, as illustrated in FIG. 20, the supported portion 73*d* of the drum bearing 73 of the cartridge B is supported by the support surface 1*e* provided in the drive-side support portion 1. The support surface 1*e* is a downwardly inclined surface. In this state, the supported portion 73*d* of the drum bearing 73 of the cartridge B is urged in an arrow K direction by a spring (not illustrated) disposed in the apparatus main body A. Since the support surface 1*e* has a downwardly inclined surface shape relative to the C1 direction, the cartridge B is moved in an arrow J1 direction of FIG. 20 along the support surface 1*e* due to its own weight and the urging force in the arrow K direction.

Figure 21:
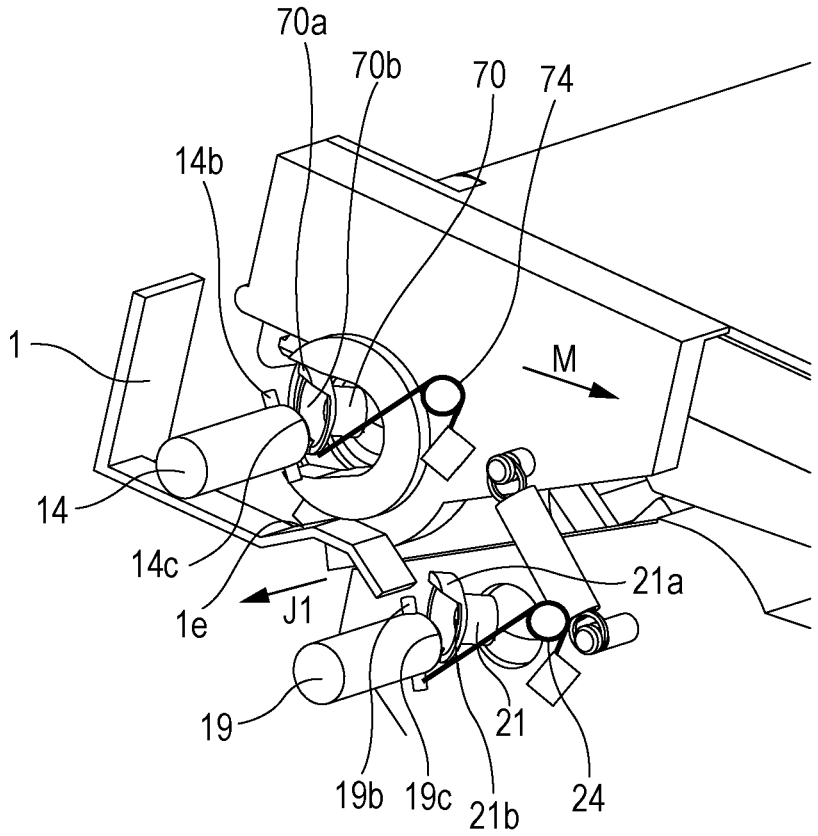
FIG. 21 is a perspective view of a state in which the couplings of the process cartridge according to the embodiment is being brought into engagement with the drive shafts of the main body.

Furthermore, during the movement of the cartridge B along the support surface 1*e*, the state illustrated in FIG. 17 is changed to a state illustrated in FIG. 21 in which the first coupling 70 and the second coupling 21 of the cartridge B start to be brought into engagement with the first drive shaft 14 and the second drive shaft 19 of the apparatus main body A. Initially, the projections 70*a* and 21*a* or the receiving surfaces 70*b* and 21*b* provided in the first coupling 70 and the second coupling 21 are brought into contact with the pins 14*b* and 19*b* and the distal end portions 14*c* and 19*c* provided in the first drive shaft 14 and the second drive shaft 19.

Next, since the cartridge B continues to be moved along the support surface 1*e*, the first coupling 70 and the second coupling 21 receive forces from the first drive shaft 14 and the second drive shaft 19 resisting the urging forces of the urging members 74 and 24. This causes the first coupling 70 and the second coupling 21 to be inclined in an arrow M direction (FIG. 21) opposite to the arrow L direction of FIG. 17. Thus, during engagement of the first coupling 70 and the second coupling 21 with the first drive shaft 14 and the second drive shaft 19, the positions of the couplings are stabilized, and from this state, the first coupling 70 and the second coupling 21 can be stably brought into engagement with the first drive shaft 14 and the second drive shaft 19.

Figure 28A:
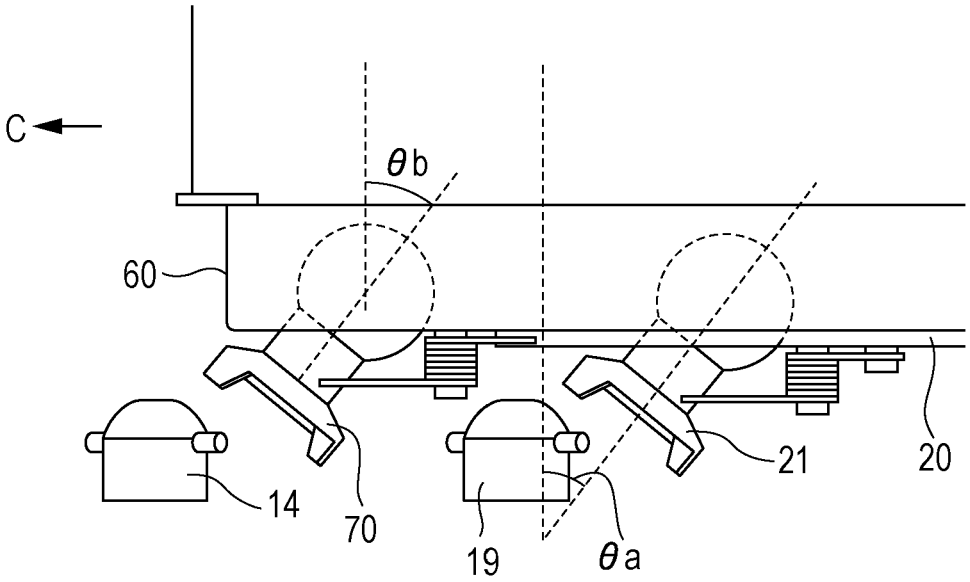
FIGS. 28A and 28B illustrate orientations of the couplings according to the embodiment.

FIG. 28A illustrates a state in which the couplings assume the second orientations (inclined orientations). That is, the tray 18 is being moved between the second position (see FIG. 6) and the first position (see FIG. 5) in this state. FIG.

28B illustrates a state in which the couplings assume the first orientations (drive orientations). That is, the tray 18 has been moved to the first position (see FIG. 5).

Figure 28B:
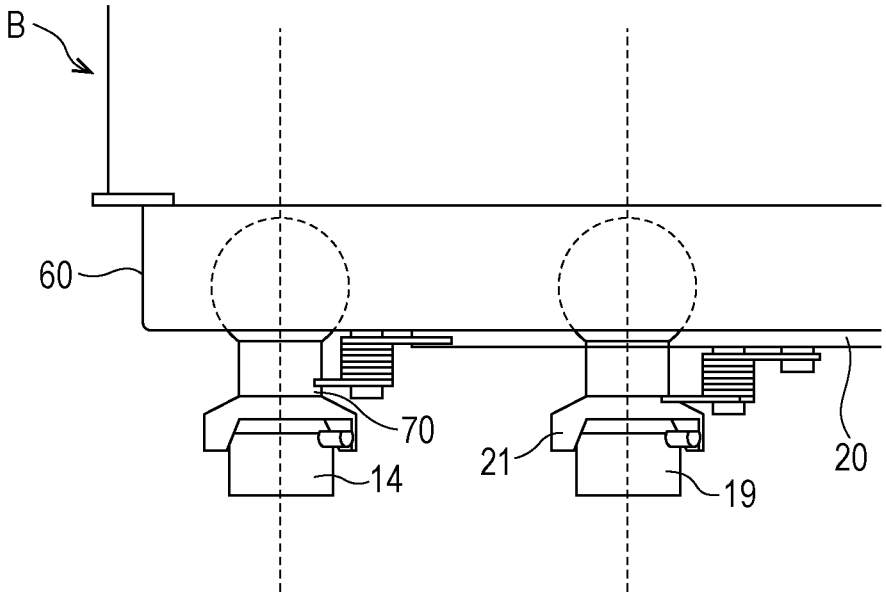

Referring to FIGS. 28A and 28B, θb represents an angle (inclination angle of the first coupling 70) formed between an axis (rotational axis) 701 of the first coupling 70 and an axis 621 of a rotating member (drum 62) to which the drive is transmitted from the coupling 70. The inclination angle θb is variable. When the first coupling 70 assumes the second orientation, θb increases compared to the case where the first coupling 70 assumes the first orientation. When the first coupling 70 assumes the first orientation, θb is substantially zero. When the first coupling 70 assumes the second orientation (inclined orientation), the distal end side of the first coupling 70 has been moved further to the downstream side in the attachment direction of the tray 18 than when the first coupling 70 assumes the first orientation (drive orientation).

Referring again to FIGS. 28A and 28B, θa represents an angle (inclination angle of the second coupling 21) formed between an axis 211 of the second coupling 21 and an axis 321 of a rotating member (developing roller 32) to which the drive is transmitted from the second coupling 21. The inclination angle θa of the second coupling 21 is also variable. When the second coupling 21 assumes the second orientation, θa increases compared to the case where the second coupling 21 assumes the first orientation. When the second coupling 21 assumes the first orientation, θa is substantially zero. When the second coupling 21 assumes the second orientation (inclined orientation), the distal end side of the second coupling 21 has been moved further to the downstream side in the attachment direction of the tray 18 than when the second coupling 21 assumes the first orientation (drive orientation).

Figure 26:
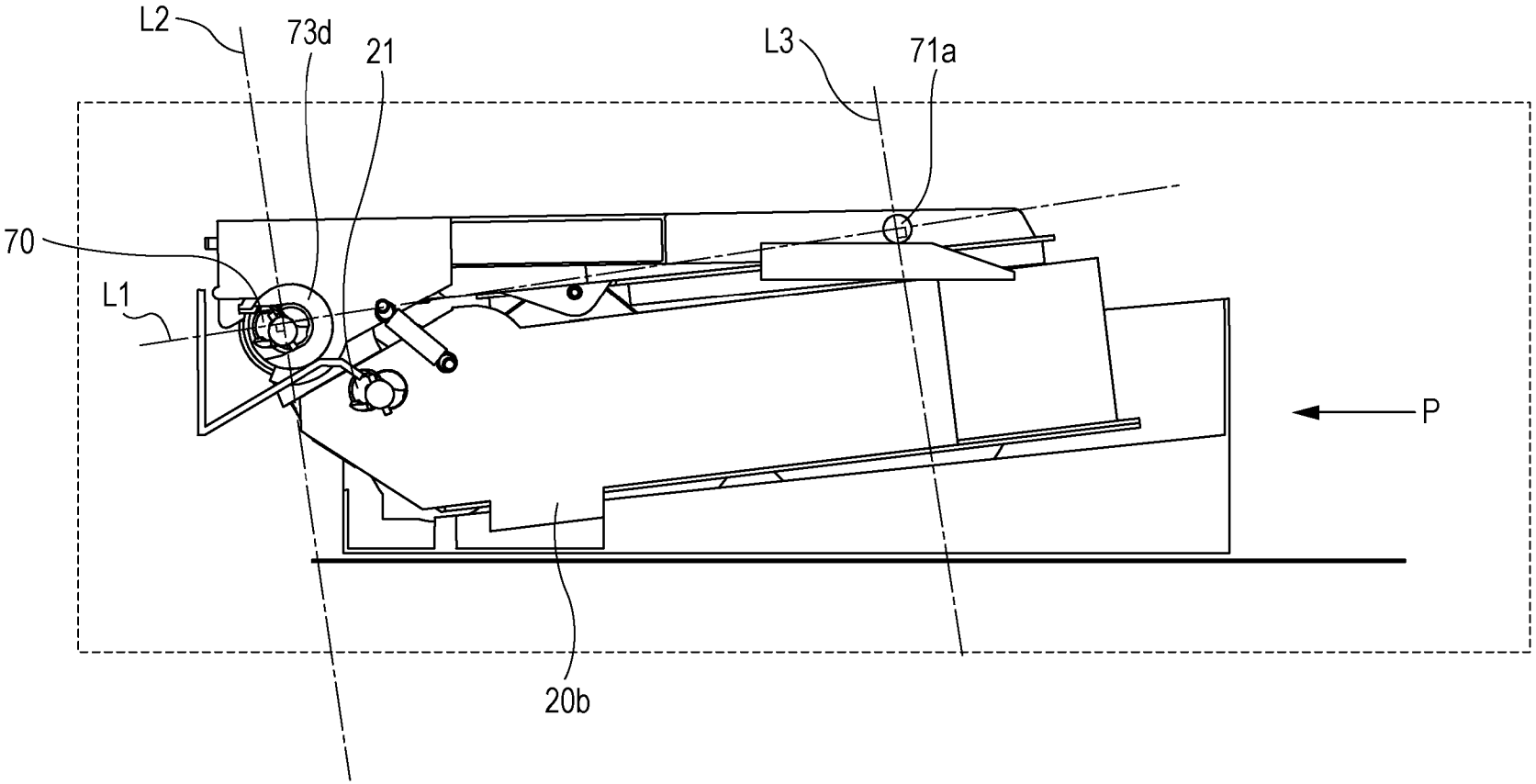
FIG. 26 is a sectional view of a state in which the process cartridge according to the embodiment is being attached to the tray.

Here, referring to FIG. 26 (plane perpendicular to the axial direction of the drum 62), a line that connects the supported portion 73*d* to the drive-side boss 71*a* is defined as L1 (first line). A line (second line) that is perpendicular to L1 and passes through the supported portion 73*d* is defined as L2. Furthermore, a line (third line) that is perpendicular to L1 and passes through the drive-side boss 71*a* is defined as L3. The supported portion 73*d* is a projection (first projection) that projects from the cleaning unit 60 in the axial direction of the drum 62 (see FIG. 8).

The drive-side boss 71*a* is a projection (second projection) that projects in the same direction as the direction in which the supported portion 73*d* projects from a photosensitive member unit (that is, the axial direction, see FIG. 8). The position regulated portion 20*b* and the second coupling 21 are disposed inside a region interposed between the line L2 and line L3 (between L2 and L3) in the cartridge B. The position regulated portion 20*b* is a projection (third projection) that projects from the developing unit 20 in a direction that intersects the axial directions of the developing roller 32 and the drum 62.

When seen from the drive side in the axial direction of the drum 62, the supported portion 73*d* is disposed so as to surround the first coupling 70.

The supported portion 73*d*, the drive-side boss 71*a*, and the position regulated portion 20*b* that determine the position of the cartridge B relative to the apparatus main body A and the tray 18 are positioned near the couplings 70 and 21. Thus, the positions of the couplings 70 and 21 can be accurately determined relative to the apparatus main body A and the tray 18. When the tray 18 is attached to the apparatus main body A, the first coupling 70 and the second coupling 21 can be stably brought into engagement with the first drive shaft 14 and the second drive shaft 19.

That is, as illustrated in FIG. 20, the supported portion 73*d* of the cartridge B is supported by the drive-side support portion 1 of the apparatus main body A and the drive-side boss 71*a* of the cartridge B is supported by the drive-side rotation support portion 2 of the apparatus main body A (supported by a plurality of portions in the attachment direction). Furthermore, a state in which the first contact surface 18*c* provided in the tray 18 and the first contacted surface 20*c* provided in the position regulated portion 20*b* are in contact with each other is maintained between the supported portion 73*d* and the drive-side boss 71*a*.

Thus, according to the present embodiment, when the user attaches the cartridge B to the apparatus main body A, the cartridge B can be stably attached without movements of the positions and the orientations of the cleaning unit 60 and the developing unit 20 included in the cartridge B in the arrow X or Y direction of FIG. 20. Accordingly, when the cartridge B is attached to the apparatus main body A, stable engagement can be realized without movements of the positions and the orientations of the first coupling 70 and the second coupling 21.

Figure 27:
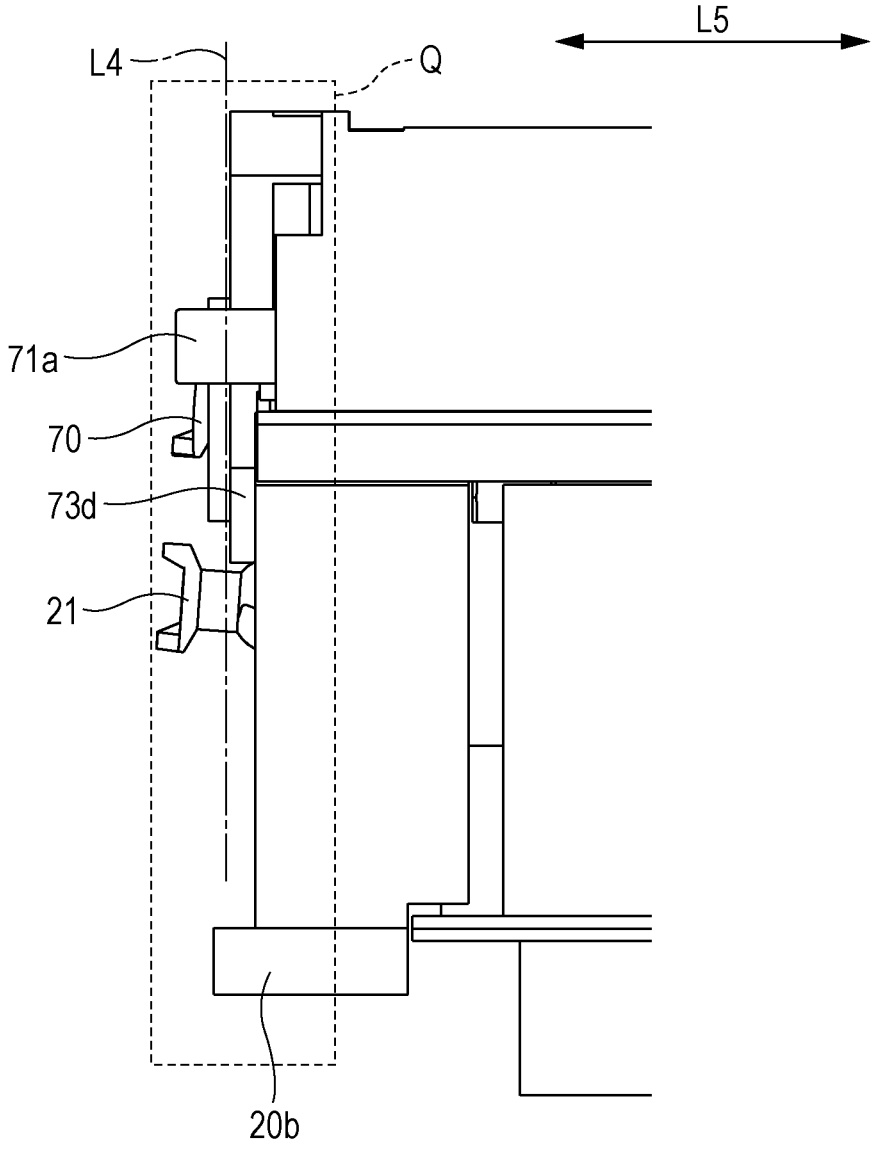
FIG. 27 is a side view of the state in which the process cartridge according to the embodiment is being attached to the tray.

Meanwhile, as illustrated in FIG. 27, which is a side view of the cartridge B seen in an arrow P direction of FIG. 26, the positions of the position regulated portion 20*b*, the supported portion 73*d*, the drive-side boss 71*a*, the first coupling 70, and the second coupling 21 are substantially the same (in a single region Q) in the longitudinal direction according to the present embodiment. In particular, the supported portion 73*d*, the drive-side boss 71*a*, the first coupling 70, and the second coupling 21 are on a line L4 perpendicular to an axial direction L5 of the drum 62.

That is, the supported portion 73*d*, the drive-side boss 71*a*, the first coupling 70, and the second coupling 21 are in the same plane (on a section taken by line L4) perpendicular to the axis (L5) of the drum 62. This can suppress changes in the positions and the orientations of the couplings due to operation performed when the cartridge B is attached to the apparatus main body, and accordingly, stable engagement of the couplings can be realized.

(4) Contact of the Supported Portion 73*b* with the Support Surface 1*f*

Figure 22:
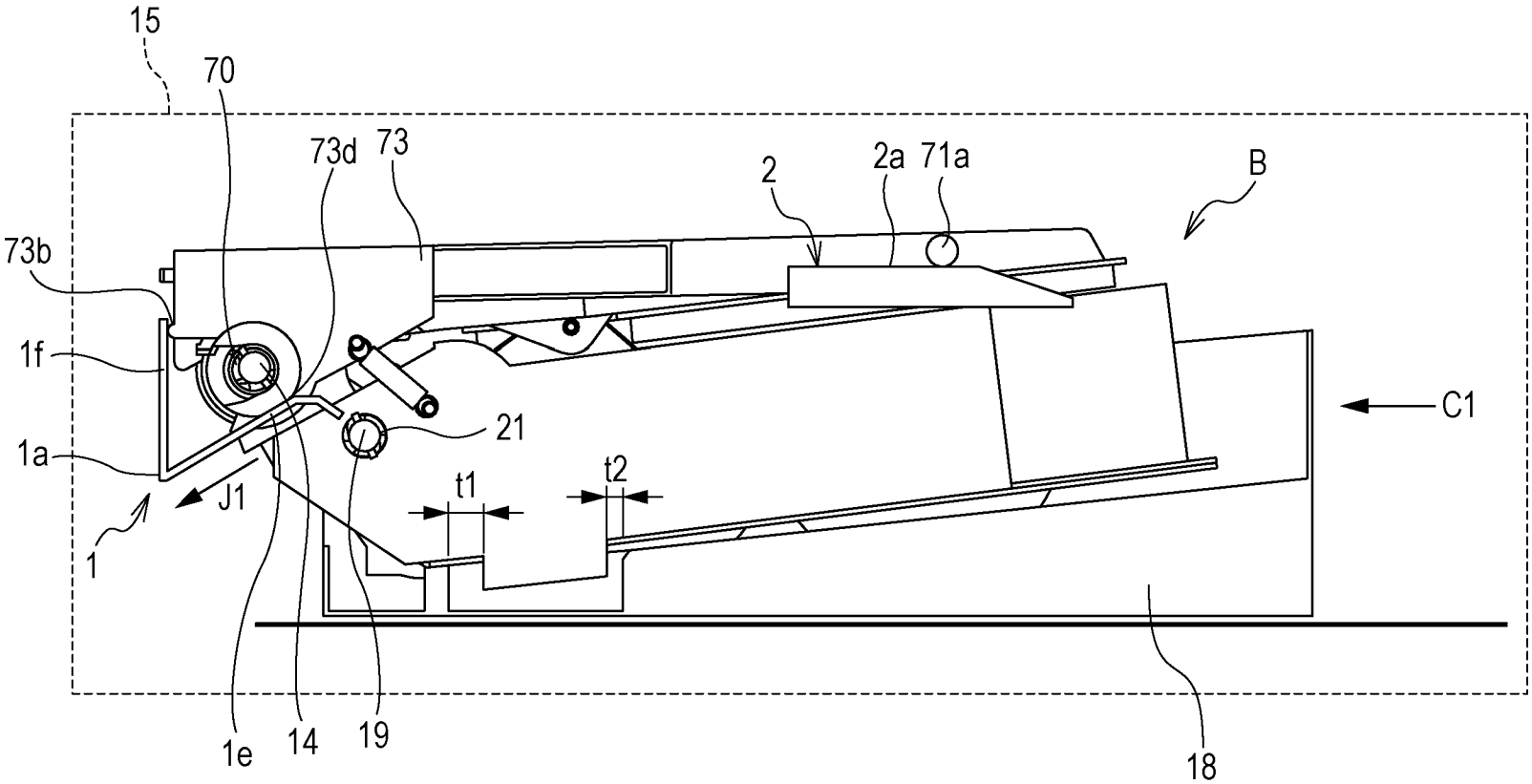
FIG. 22 is a sectional view of the tray in a state in which the process cartridge according to the embodiment is attached to the tray.

Next, referring to FIG. 22, when the cartridge B is moved by a certain amount along the support surface 1*e*, the supported portion 73*b* of the drum bearing 73 is brought into contact with the support surface 1*f* of the support portion 1*a* (at this time, the supported portion 73*d* is positioned at the support surface 1*e* of the support portion 1*a* and the drive-side boss 71*a* is positioned at the rotation support surface 2*a*). Furthermore, the first contact surface 18*c* is brought out of contact from the first contacted surface 20*c*. In this state (the cartridge B is not in contact with the tray 18 in the horizontal direction and the up-down direction), the process cartridge B is positioned in the apparatus main body A and the attachment of the process cartridge B to the apparatus main body A is completed. The position of the tray 18 at this time is set as an image forming position.

Figure 23:
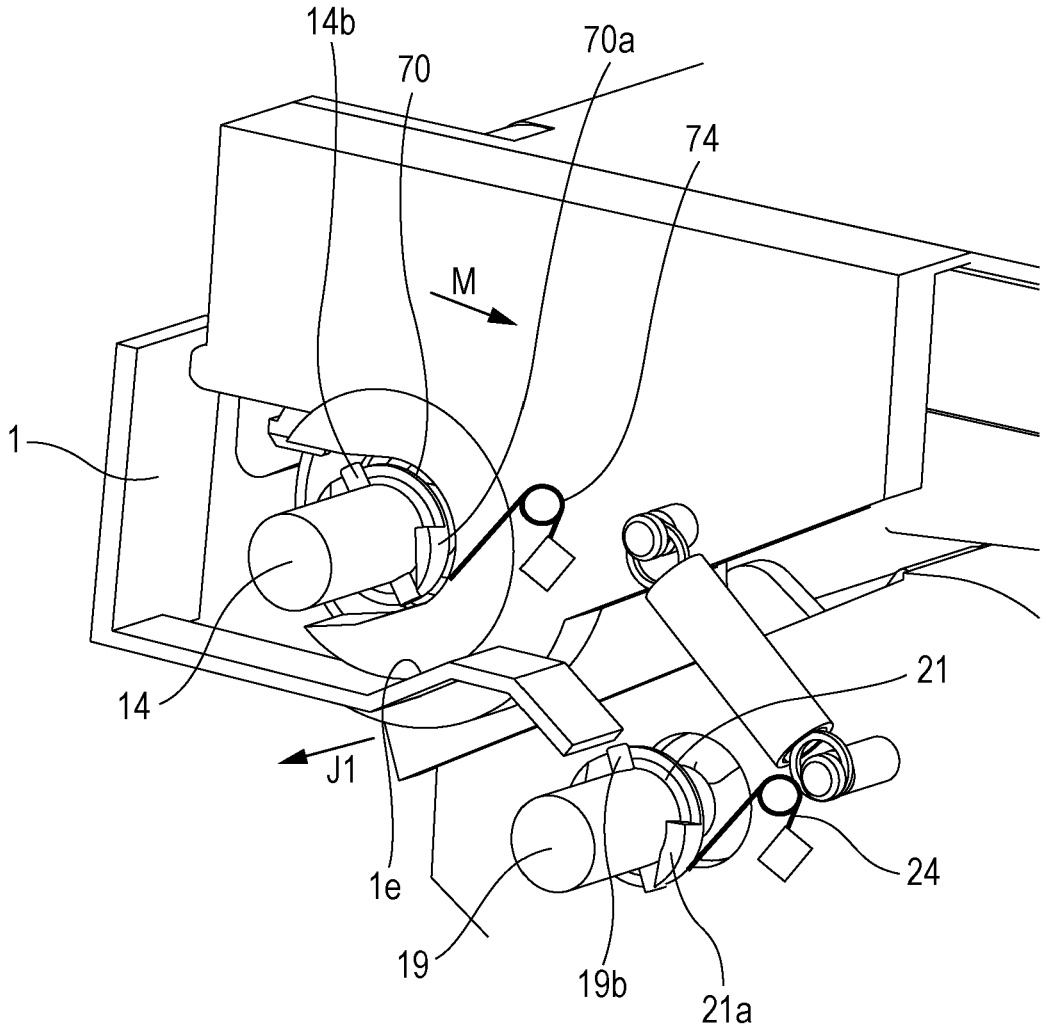
FIG. 23 is a perspective view of a state in which the couplings of the process cartridge according to the embodiment is engaged with the drive shafts of the main body.

The first coupling 70 and the second coupling 21 are further inclined in the arrow M direction of FIG. 23. Furthermore, the projections 70*a* and 21*a* are brought into engagement with the pins 14*b* and 19*b*, and the receiving surfaces 70*b* and 21*b* are brought into contact with the distal portions 14*c* and 19*c*. Thus, the drive is transmitted from the first drive shaft 14 and the second drive shaft 19 to the drum 62 and the developing roller 32 by a drive transmission device (not illustrated). Thus, engagement of the couplings to the drive shafts is completed. That is, the above-described change from the second orientations (inclined orientations) to the first orientations (drive orientations) is completed.

Detachment of the Cartridge from the Apparatus Main Body

Next, detachment of the cartridge B from the apparatus main body A is described. When the attachment of the process cartridge B to the apparatus main body A is completed as illustrated in FIGS. 2 and 22, the gap t2 is formed between the first contact surface 18*c* and the first contacted surface 20*c* and the gap t1 is formed between the second contact surface 18*d* and the second contacted surface 20*d*.

Figure 24:
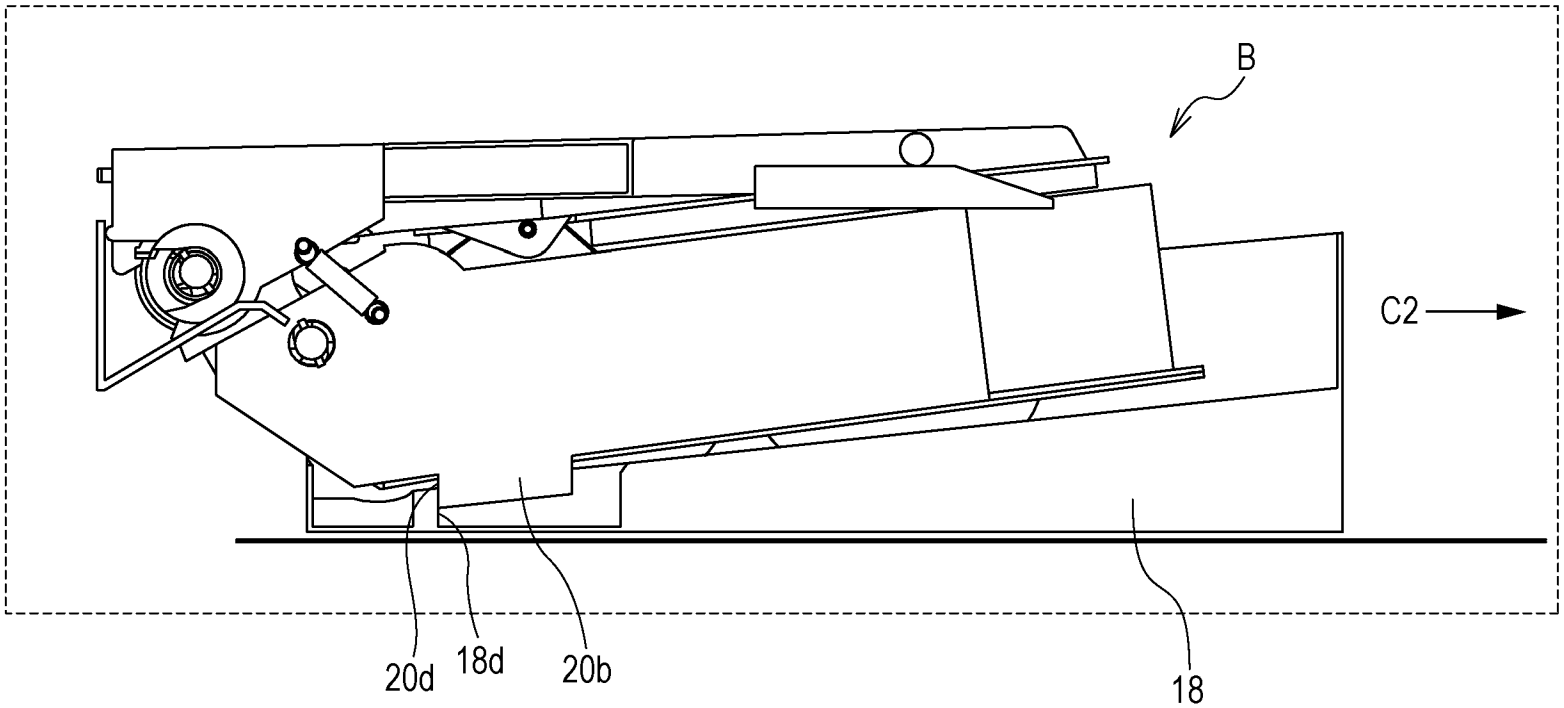
FIG. 24 is a sectional view of the tray in a state in which the process cartridge according to the embodiment is being detached from the tray.

In this state, the cartridge B is positioned by the support surface 1*f* (FIG. 20) of the support portion 1*a* and the rotation support surface 2*a*. Thus, as illustrated in FIG. 24, when the tray 18 is moved in the arrow C2 direction of FIG. 24, only the tray 18 is moved. This sets the gap t2 to zero and brings the second contact surface 18*d* into contact with the second contacted surface 20*d*. Furthermore, as the tray 18 continues to be moved in the C2 direction as illustrated in FIG. 24, the supported portion 73*d* is guided by the guide surface 1*e*. This moves the process cartridge B in the arrow J2 direction of FIG. 25.

Figure 25:
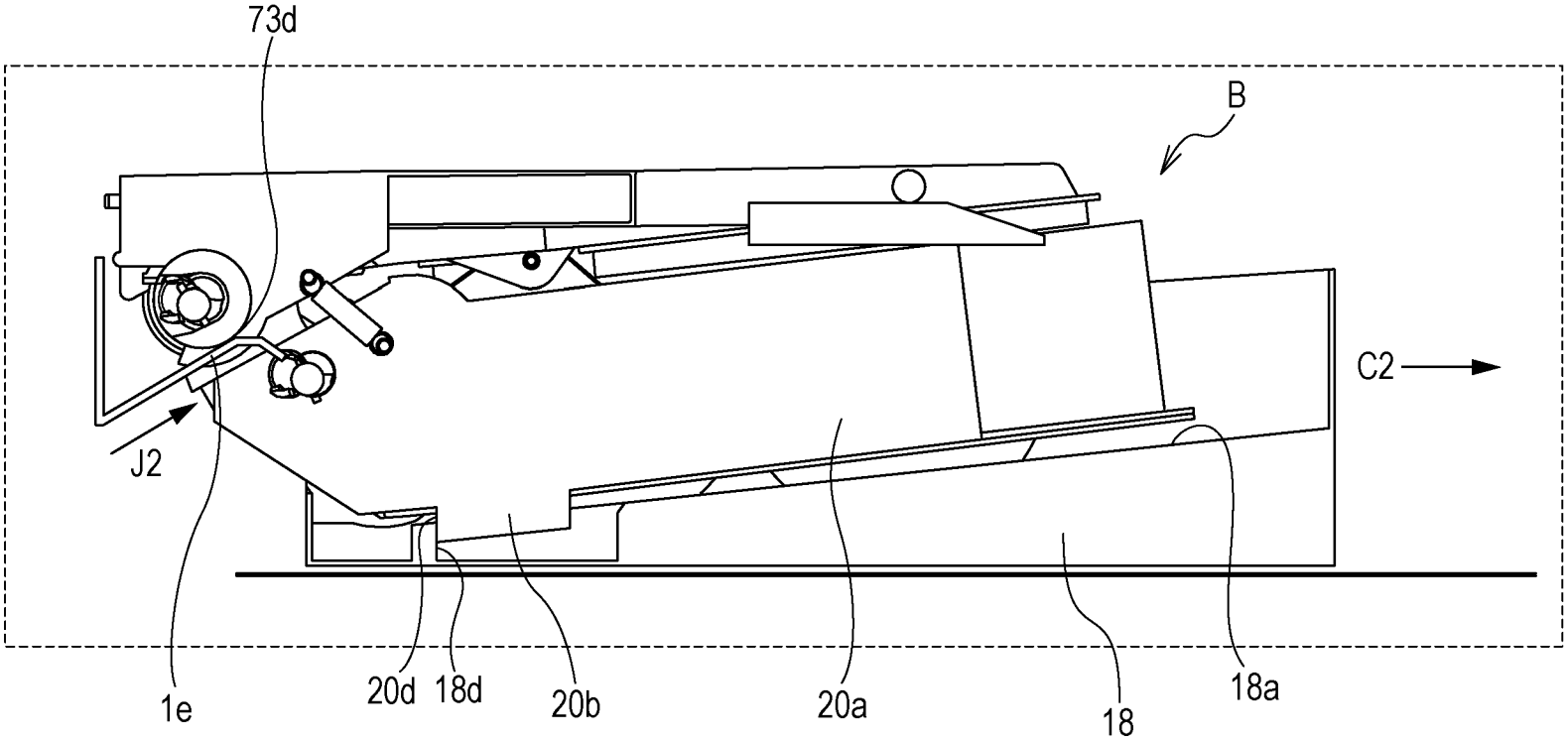
FIG. 25 is a sectional view of the tray in a state in which the process cartridge according to the embodiment is being detached from the tray.

Furthermore, when the tray 18 continues to be moved in the arrow C2 direction of FIG. 25, the support for the cartridge B is changed from the drive-side support portion 1 and the drive-side rotation support portion 2 to the support surface 18*a* provided in the tray 18 in the reverse to the change occurring when the cartridge B is being attached (change in the support members for the cartridge B). By further moving the tray 18 in the arrow C2 direction of FIG. 25, the tray 18 can be returned to the attachment and detachment position of the cartridge B illustrated in FIG. 1. In this state, by holding the handle (not illustrated) and moving the cartridge B from the attachment and detachment position in the E2 direction, detachment of the cartridge B from the apparatus main body A is completed.

As has been described, according to the present embodiment, even the heavy process cartridge can be correctly attached through a simple operation of only moving the tray 18 in the horizontal direction, and accordingly, convenience of the user for the attachment of the cartridge can be improved. Furthermore, while considering contact or separation of the process cartridge with the tray in the displacement direction of the tray, a stable attachment property of the process cartridge can be improved by utilizing the drive-side support portion 1 and the drive-side rotation support portion 2. Furthermore, when the first coupling 70 and the second coupling 21 start to be brought into engagement with the first drive shaft 14 and the second drive shaft 19, the position and the orientation of the process cartridge B can be stabilized.

Accordingly, the positions of the first coupling 70 and the second coupling 21 can also be stabilized, and from this state, the first coupling 70 and the second coupling 21 can be brought into engagement with the first drive shaft 14 and the second drive shaft 19.

Variants

Although the embodiment of the present invention has been described, the present invention is not limited to this embodiment. A variety of variants and modifications are possible without departing from the gist of the present invention.

First Variant

According to the above-described embodiment, the process cartridge is described as the cartridge. That is, the photosensitive drum (photosensitive member) and the process devices acting on this photosensitive drum are integrated with one another in the cartridge so as to be detachably attachable to the main body of the image forming apparatus. However, the present invention is not limited to this. For example, the present invention is also applicable to an apparatus that only includes one of a photosensitive drum serving as an image bearing member and a developing roller serving as a developer bearing member disposed in the apparatus as a cartridge.

Second Variant

Although a structure provided with two inclinable couplings is described according to the above-described embodiment, the present invention is also applicable to a structure that includes a single coupling.

Third Variant

Although the monochrome cartridge is described according to the above-described embodiment, the present invention is also applicable to a color cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

Fourth Variant

Although it has been described that the cartridge is detachable and attachable while part of the tray is outside the apparatus main body according to the above-described embodiment, the present invention is also applicable to a structure with which the cartridge is detachable and attachable while the entirety of the tray is outside the apparatus main body.

This application claims the benefit of Japanese Patent Application No. 2014-240826, filed Nov. 28, 2014, which is hereby incorporated by reference herein in its entirety.

What is claimed is:

1. An image forming apparatus comprising:

an apparatus main body; and a cartridge that includes at least one rotating member, and at least one coupling arranged to engage with a drive member on the apparatus main body side so as to receive a drive force to rotate the at least one rotating member, the at least one coupling including an end portion engaging with the drive members, wherein the image forming apparatus includes a movement member arranged to move the cartridge and which is movable between a first position for disposing the cartridge at a position where image formation is possible and a second position where the cartridge is disposed outside of the apparatus main body and attachable to and detachable from the movement member, wherein, when the movement member is positioned at the first position, the at least one coupling is arranged to engage with the drive member so as to be positioned at a drive position where the at least one coupling is able to rotate the at least one rotating member, and wherein the at least one coupling is moveable to the drive position and an inclined position, and the at least one coupling inclines so that the end portion when the at least one coupling is at the inclined position to be closer to a downstream side with respect to a moving direction of the movement member moving from the second position to the first position, than when the end portion is at the drive position, wherein the movement member comprises a contact portion configured to move the cartridge by contacting on the cartridge when moving from the first position to the second position, and wherein in case where the movement member is moved from the first position to the second position, the at least one coupling is moved from the drive position to the inclined position in response to a movement of the cartridge pressed by the contact portion.

2. The image forming apparatus according to claim 1, wherein the movement member includes a position regulating portion arranged to regulate a position of the cartridge in the movement direction from the second position to the first position, wherein the cartridge includes a position regulated portion a position of which is regulated by the position regulating portion, wherein, while the movement member is being moved from the second position to the first position, the position regulated portion and the position regulating portion are brought into contact with each other, and wherein, while the at least one coupling is being inclined from the inclined position to the drive position, the position regulated portion and the position regulating portion are brought out of contact from each other.

3. The image forming apparatus according to claim 1, wherein the apparatus main body includes a guide arranged to support the cartridge, and wherein the cartridge includes a supported portion supported by the guide.

4. The image forming apparatus according to claim 3, wherein an upwardly inclined surface portion, a downwardly inclined surface portion, and a positioning surface portion are provided in the guide in this order in a displacement direction in which the movement member is displaced from the second position to the first position.

5. The image forming apparatus according to claim 4, wherein, while the supported portion is being displaced from the upwardly inclined surface portion of the guide to the downwardly inclined surface portion of the guide, contact of the cartridge with the movement member in a direction intersecting the displacement direction from the second position to the first position is eliminated.

6. The image forming apparatus according to claim 1, wherein the cartridge includes an urging member arranged to urge the at least one coupling from the drive position toward the inclined position, and wherein, while the movement member is being moved from the second position to the first position, the drive member is arranged to move the at least one coupling to the drive position against an urging force of the urging member.

7. The image forming apparatus according to claim 1, wherein the at least one rotating member included in the cartridge is an image bearing member on which a latent image can be formed.

8. The image forming apparatus according to claim 1, wherein the at least one rotating member included in the cartridge is a developer bearing member arranged to bear developer so as to develop a latent image.

9. The image forming apparatus according to claim 1, wherein the at least one rotating member included in the cartridge is a conveyance member that conveys developer.

10. The image forming apparatus according to claim 1, wherein, in the cartridge, the at least one coupling includes two couplings, one of the two couplings is a first coupling and another of the two couplings is a second coupling, and the at least one rotating member includes a plurality of rotating members, wherein one of the plurality of rotating members to which a drive force received by the first coupling is transmitted is an image bearing member on which a latent image can be formed, and wherein another of the plurality of rotating members to which a drive force received by the second coupling is transmitted is a developer bearing member arranged to bear developer so as to develop any latent image formed on the image bearing member.

* * * * *